US010571104B2

(12) United States Patent
Qiu

(10) Patent No.: US 10,571,104 B2
(45) Date of Patent: Feb. 25, 2020

(54) PORTABLE LAMP AND MANUFACTURING METHOD THEREOF

(71) Applicant: NINGBO FUTAI ELECTRIC LIMITED, Ningbo, Zhejiang (CN)

(72) Inventor: Fujun Qiu, Ningbo (CN)

(73) Assignee: NINGBO FUTAI ELECTRIC LIMITED, Ningbo, Zhejiang (CN)

( * ) Notice: Subject to any disclaimer, the term of this patent is extended or adjusted under 35 U.S.C. 154(b) by 0 days.

(21) Appl. No.: 16/140,483

(22) Filed: Sep. 24, 2018

(65) Prior Publication Data

US 2019/0093867 A1 Mar. 28, 2019

(51) Int. Cl.

| | |
|---|---|
| ***F21V 21/30*** | (2006.01) |
| ***F21V 21/40*** | (2006.01) |
| ***F21L 4/04*** | (2006.01) |
| ***F21V 21/14*** | (2006.01) |
| *F21Y 115/10* | (2016.01) |

(52) U.S. Cl.

CPC ..... *F21V 21/406* (2013.01); *F21L 4/04* (2013.01); *F21V 21/145* (2013.01); *F21V 21/30* (2013.01); *F21Y 2115/10* (2016.08)

(58) Field of Classification Search

CPC ..... F21L 4/04; F21V 21/406; F21V 21/145; F21V 21/30

USPC ..... 362/249.1

See application file for complete search history.

(56) References Cited

U.S. PATENT DOCUMENTS

| | | | | |
|---|---|---|---|---|
| 6,685,067 | B2 * | 2/2004 | French | F41C 33/0227 224/192 |
| 10,072,829 | B1 * | 9/2018 | Christ | F21V 21/30 |
| 2010/0232147 | A1 * | 9/2010 | Bryant | F21L 4/08 362/183 |
| 2011/0141737 | A1 * | 6/2011 | Gu | F21S 6/003 362/249.1 |
| 2011/0216532 | A1 * | 9/2011 | Bryant | F21L 4/08 362/183 |
| 2011/0255286 | A1 * | 10/2011 | Christ | F21L 4/08 362/249.02 |
| 2012/0140473 | A1 * | 6/2012 | Chang | F21S 2/005 362/249.03 |
| 2013/0100653 | A1 * | 4/2013 | Renk, Jr. | F21L 4/022 362/184 |
| 2013/0329430 | A1 * | 12/2013 | Christ | F21L 4/08 362/249.03 |
| 2014/0334155 | A1 * | 11/2014 | Christ | F21L 4/08 362/249.03 |

(Continued)

*Primary Examiner* — Christopher M Raabe

(74) *Attorney, Agent, or Firm* — Raymond Y. Chan; David and Raymond Patent Firm

(57) ABSTRACT

A portable lamp includes at least one lighting device and at least one handle body. The at least one handle body has two end portions and a turning space defined between the two end portions. The at least one lighting device is rotatably mounted between the two end portions of the at least one handle body. The at least one lighting device is selectively arranged to be maintained in the turning space of the at least one handle body as a folded state and rotated with the at least one handle body to have an included angle between the at least one lighting body and the at least one handle body as an unfolded state. The portable lamp can adjust the state of the at least one lighting device without moving the at least one handle body.

25 Claims, 28 Drawing Sheets

(56) References Cited

U.S. PATENT DOCUMENTS

| | | | | |
|---|---|---|---|---|
| 2016/0033119 | A1* | 2/2016 | Mumma | F21L 14/00<br>362/249.09 |
| 2018/0031214 | A1* | 2/2018 | Li | F21S 9/02 |
| 2018/0224101 | A1* | 8/2018 | Qiu | F21V 21/28 |

* cited by examiner

PORTABLE LAMP AND MANUFACTURING METHOD THEREOF

CROSS REFERENCE OF RELATED APPLICATION

This is a non-provisional application that claims the benefit of priority under 35 U.S.C. § 119 to a Chinese application, application number 201710868479.4, filed Sep. 22, 2017, which is incorporated herewith by reference in its entity.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a lighting lamp, especially to a portable lamp and a manufacturing method thereof.

Description of Related Arts

As a lamp is powered by electricity, its emitting light can light up its environment. The portable lamp is popular to users who need to carry it elsewhere with them. A conventional portable lamp is illustrated in FIGS. 1A to 1C, which comprises a pair of C-shape first lighting member 10P and second lighting member 20P, and a power source 30P for the first and second lighting members 10P, 20P. The first lighting member 10P comprises a first lighting portion 11P, a first lamp body 12P and a handle 13P. The first lamp body 12P comprises a first lamp main body 121P and two first extending arms 122P. Two ends of the two first extending arms 122P are disposed respectively at two sides of the first lamp main body 121P. The other ends of the two first extending arms 122P are pivotally connected to two ends of the handle 13P respectively, wherein a first operating space is formed between the first lamp main body 121P, the first extending arms 122P and the handle 13P, wherein the first lighting portion 11P is disposed on the first lamp main body 121P. The power source 30P is provided within the handle 13P and electrically connected with the first lighting portion 11P. The second lighting member 20P comprises a second lighting portion 21P and a second lamp body 22P. The second light body 22P comprises a second lamp body 221P and two second extending arms 222P. Two ends of the second extending arms 222P are respectively disposed at two sides of the second lamp body 221P, and the other two ends of the second extending arms 222P are pivotally connected to the first extending arms 122P of the first lamp body 12P respectively, wherein a second operating space is formed between the second lamp body 221P, each of the second extending arms 222P, and the handle 13P. The second lighting portion 21P is disposed on the second lamp body 221P. The second lighting portion 21P is electrically connected to the power source 30P. The first lighting portion 11P of the portable lamp is disposed on the first lamp body 12P, so that the first lighting portion 11P is synchronously and identically rotated with the first lamp body 12P with the same amplitude. Correspondingly, the second lighting portion 21P is disposed on the second lamp body 22P so that the second lighting portion 21P is synchronously and identically rotated with the second lamp body 22P with the same amplitude.

When the portable lamp is not in use, the first lamp body 12P of the first lighting member 10P and the second lamp body 22P of the second lighting member 20P can be overlapped with each other, wherein the first lighting portion 11P and the second lighting portion 21P are both hidden between the first lamp body 12P and the second lamp body 22P which are overlapped with each other, as shown in FIG. 1A, wherein the operating space and the second operating space are corresponding to each other to allow a user to lift and carry the portable lamp through the handle 13P.

As shown in FIGS. 1B and 1C, when the portable lamp is in use, the first lamp body 12P and the second lamp body 22P must be rotated along the handle 13P from the overlapping folded state to separate from each other to an unfolded state, wherein the first lighting portion 11P and the second lighting portion 21P are exposed to outside and, when the first lighting portion 11P and the second lighting portion 21P are respectively powered by the power source 30P, the first lighting portion 11P and the second lighting portion 21P generate illuminating light in the surrounding environment. However, the radiation direction of the light emitted from the first lighting portion 11P and the second lighting portion 21P are limited by the unfolding direction of the first lamp body 12P and the second lamp body 22P, that reduces the adaptability of the portable lamp to the environment. For example, as shown in FIG. 1B, if it is desired that the lights generated by the first lighting portion 11P and the second lighting portion 21P emit in the same direction, the first lamp body 12P and the second lamp body 22P must be unfolded to a parallel position and aligned on the same plane. At this time, the portable lamp is placed on a supporting surface (such as but not limited to the ground, the desktop, etc.) in line and has a poor stability. Especially as the portable lamp is used outdoors, gentle wind or even a slight vibration on the portable lamp may cause the portable lamp to fall down, which seriously affects the normal use the portable lamp. As shown in FIG. 1C, if the portable lamp is desired to have higher stability, the first lamp body 12P and the second lamp body 22P is preferred to be unfolded in a V-shape and to have an acute angle therebetween. In other words, portable lamp and the supporting surface have a triangular contact relation, wherein the lights generated by the first lighting portion 11P and the second lighting portion 21P have different emitting and radiation directions, resulting in a less effective lighting effect for the light provided by the portable lamp, that fails to meet the illuminating requirement of the user.

Furthermore, the first lighting portion 11P is provided on the first lamp main body 121P of the first lamp body 12P, so that when the first lamp body 12P is deployed, the first lighting portion 11P is located on a side away from the handle 13P of the first lamp body 12P. Correspondingly, the second lighting portion 21P is provided on the second lamp main body 221P of the second lamp body 22P, so that when the second lamp body 22P is deployed, the second lighting portion 21P is located a side away from the handle 13P of the second lamp body 22P too. In other words, when the portable lamp is use, the distance between the first lighting portion 11P and the second lighting portion 21P is relatively far from each other, which causes the portable lamp failing to provide a concentrated light for illuminating purpose of the portable lamp.

SUMMARY OF THE PRESENT INVENTION

The invention is advantageous in that a portable lamp and a manufacturing method thereof are provided that the portable lamp comprises at least one handle body and at least two lighting devices, wherein a position of each of the lighting devices is adjustable relative to the at least one handle body and the light radiation direction of each of the lighting devices can be adjusted as needed.

Another advantage of the invention is to provide a portable lamp and a manufacturing method thereof, wherein the position and angle of each of the lighting devices with respect to the at least one handle body can be adjusted by rotation to have a large angle therebetween, so as to provide a more convenient and practical usage of the portable lamp for its user.

Another advantage of the invention is to provide a portable lamp and a manufacturing method thereof, wherein the position and the angle of each of the lighting devices with respect to the at least one handle body can be adjusted in a rotating manner for 360° so that the portable device is more conveniently useful to the user.

Another advantage of the invention is to provide a portable lamp and a manufacturing method thereof, wherein the portable lamp allows a user to adjust only each of the lighting devices without adjusting the at least one handle body to provide the desired lighting effect by the portable lamp.

Another advantage of the invention is to provide a portable lamp and a manufacturing method thereof that the lighting devices and the at least one handle body can be adjusted independently, including their relative positions and angles, wherein the adjustment of the light radiation direction of each of the lighting devices is not limited by the position and the state of the at least one handle body, so that the portable lamp can be used flexibly by users.

Another advantage of the invention is to provide a portable lamp and a manufacturing method thereof, wherein each of the lighting devices can be naturally maintained in the adjusted position and state after adjustment, in such a manner that, the user can quickly adjust the position and state of the portable lamp.

Another advantage of the invention is to provide a portable lamp and a manufacturing method thereof, wherein there are two lighting devices preferably and the relative positions and angles of the two lighting devices can be adjusted respectively and independently, allowing the two lighting devices to emit light towards the same direction.

Another advantage of the invention is to provide a portable lamp and a manufacturing method thereof, wherein two of the lighting devices are capable of simultaneously providing lights towards two opposite directions respectively.

Another advantage of the invention is to provide a portable lamp and a manufacturing method thereof, wherein the operating state of each of the lighting devices can be individually controlled so that the lighting state of the portable lamp can be selected and adjusted as desired.

Another advantage of the invention is to provide a portable lamp and a manufacturing method thereof, wherein two of the lighting devices are arranged adjacent to each other so that when two of the lighting devices emit light to the same direction, the light sources provided by the two lighting devices are concentrated to enhance impact of light. In other words, two adjacent lighting devices can enhance the intensity of light generated by the portable lamp by increasing the lighting area.

Another advantage of the invention is to provide a portable lamp and a manufacturing method thereof, wherein there are two handle bodies and the relative positions and angles of the two handle bodies can be adjusted to allow the user to select the operating state of the portable lamp.

Another advantage of the invention is to provide a portable lamp and a manufacturing method thereof, wherein two of the handle bodies can be unfolded in an unfolded state and placed on a supporting surface, wherein the two handle bodies are stood on and in contact with the supporting surface in a triangular manner so that the portable lamp can be stably maintained in an operating environment.

Another advantage of the invention is to provide a portable lamp and a manufacturing method thereof, wherein the two handle bodies can be unfolded in an unfolded state and placed on a supporting surface, wherein two of the handle bodies can be stood on and in contact with the supporting surface in a "II" shape manner so that the portable lamp can be stably maintained in the operating environment.

Another advantage of the present invention is to provide a portable lamp and a manufacturing method thereof, wherein when the two handle bodies are in an unfolded state, two of the lighting devices can be arranged to emit light in the same direction, so that the light sources of the portable lamp can be concentrated to enhance the light beams.

Another advantage of the invention is to provide a portable lamp and a manufacturing method thereof, wherein two of the handle bodies can be folded up to a folded state while the lighting devices still provide light. For example, the lighting devices can still provide illuminating light for the operating environment when the two handle bodies are folded up together.

Another advantage of the invention is to provide a portable lamp and a manufacturing method thereof, wherein two of the handle bodies can be folded up to a folded state so that the portable lamp allows the user to hold the two the handle bodies in the folded state as a handle member while using the portable lamp.

Another advantage of the invention is to provide a portable lamp and a manufacturing method thereof, wherein the portable lamp provides an adjusting device which connects the two handle bodies with the two lighting devices, wherein the adjusting device allows each of the lighting devices to make various adjustments with respect to each of the handle bodies and to naturally maintain their adjusted positions.

Another advantage of the invention is to provide a portable lamp and a manufacturing method thereof, wherein the adjusting device allows the positions and angles of the two lighting devices to be adjusted and be naturally maintained after being adjusted.

Another advantage of the invention is to provide a portable lamp and a manufacturing method thereof, wherein the adjusting device allows the positions and angles of the two handle bodies to be adjusted and be naturally held in such adjusted positions.

Another advantage of the invention is to provide a portable lamp and a manufacturing method thereof, wherein the adjusting device comprises a rotation shaft and two adjusting units disposed at two ends of the rotation shaft respectively, wherein each of the lighting devices is coupled with the rotation shaft, wherein the two handle bodies are respectively provided at the two adjusting units, so that when the rotation shaft is driven to rotate with respect to the adjusting units, the positions of the lighting devices with respect to the handle bodies are adjustable.

Another advantage of the invention is to provide a portable lamp and a manufacturing method thereof, wherein each of the lighting devices is detachably coupled with the rotation shaft, so that each of the lighting devices can be simply replaced independently when it is out of order due to damaging, loss of power, or the like, such that it is advantageous to reduce the maintenance cost and the usage cost of the portable lamp.

Another advantage of the invention is to provide a portable lamp and a manufacturing method thereof, wherein each of the lighting devices is detachably coupled with the rotation shaft respectively, allowing each of the lighting devices to be used independently even after detached from the rotation shaft.

Additional advantages and features of the invention will become apparent from the description which follows and may be realized by mechanism of the instrumentalities and combinations particularly point out in the appended claims.

According to the present invention, the foregoing and other objects and advantages are attained by a portable lamp comprising:

at least one handle body having two end portions and a turning space between the two end portions; and at least one lighting device which is rotatably mounted between the two end portions of the at least one handle body and selectively arranged to be maintained within the turning space of the at least one handle body as a folded state and to rotate with respect to the at least one handle body to define an included angle between the at least one lighting device and the at least one handle body as an unfolded state.

According to one embodiment of the present invention, the at least one handle body comprises a handle element and two extending arms extended from two ends of the handle element respectively, wherein the turning space is defined between the handle element and the two extending arms, wherein the other free ends of the two extending arms of the at least one handle body are rotatably coupled with two ends of the at least one lighting device.

According to one embodiment of the present invention, the portable lamp further comprises an adjusting device which comprises a rotation shaft and two adjusting units, wherein the at least one lighting device is coupled with the rotation shaft and the two adjusting units are respectively coupled with the free ends of the two extending arms respectively, wherein both ends of the rotation shaft are rotatably coupled with the two adjusting units respectively, so that the at least one lighting device is rotatably coupled with the at least one handle body.

According to one embodiment of the present invention, a pair of handle bodies is provided, wherein one of the handle bodies is defined as a first handle body, and the other handle body is defined as a second handle body, wherein the free ends of the two extending arms of the first handle body are respectively and rotatably coupled with the free ends of the two extending arms of the second handle body through the two adjusting units respectively, so that the first handle body and the second handle body are able to be switched between a unfolded state where the first and second handle bodies are rotated away from each other about the adjusting units and a folded state where the first and second handle bodies are rotated to overlap with each other about the adjusting units.

According to one embodiment of the present invention, a pair of the lighting devices is provided, wherein one of the lighting devices is defined as a first lighting device, and the other lighting device is defined as a second lighting device. The first lighting device and the second lighting device are rotatably arranged with respect to each other.

According to one embodiment of the present invention, each of the adjusting units has a first slot and each of the two ends of the rotation shaft has a first projection, wherein the two first projections of the rotation shaft are rotatably disposed in the two first slots of each of the adjusting units respectively.

According to one embodiment of the present invention, each of the adjusting units has a first projection, and each of the two ends of the rotation shaft has a first slot, wherein the two first projections of each of the adjusting units are rotatably disposed in the two first slots of the rotation shaft respectively.

According to one embodiment of the present invention, each of the adjusting units has a set of third positioning slots spaced from each other, wherein the adjusting device further comprises two positioning units respectively disposed on the two ends of the rotation shaft, wherein each of the positioning units comprises a third positioning element and a third resilient element retained between the third positioning element and the rotation shaft, wherein a positioning end of the third positioning element is able to positioned in different positions of the third positioning slot of the respective adjusting unit.

According to one embodiment of the present invention, the rotation shaft comprises a first rotating unit and a second rotating unit, wherein the first rotating unit is disposed on the first lighting device and the second rotating unit is disposed on the second lighting device, wherein the first rotating unit is rotatably coupled with the second rotating unit and, accordingly, the first rotating unit is rotatably coupled with one of the first and second adjusting units while the second rotating unit is rotatably coupled with another of the first and second rotating units.

According to one embodiment of the present invention, the rotation shaft comprises two first rotating units and two second rotating units. One of the first rotating units is coupled with an end portion of the first lighting device while another one of the first rotating units is coupled with a middle portion of the first lighting device. One of the second rotating units is coupled with an end portion of the second lighting device while another one of the second rotating units is coupled with a side portion of the second lighting device, wherein the second rotating unit positioned at the middle portion of the second lighting device is rotatably coupled between the two first rotating units, and the first rotating unit positioned at the middle portion of the first lighting device is rotatably coupled between the two second rotating units, wherein the first rotating unit positioned at the end portion of the first lighting device is rotatably coupled with one of the adjusting units, and the second rotating unit positioned at the end portion of the second lighting device is rotatably coupled with another one of the adjusting units.

According to one embodiment of the present invention, each of the lighting devices is independently and detachably coupled with the rotation shaft.

According to one embodiment of the present invention, the rotation shaft comprises two first rotating units, one second rotating unit and two mounting members, wherein the two first rotating units are rotatably coupled with the adjusting units respectively, and the second rotating unit is rotatably coupled between the two first rotating units, wherein one of the mounting members is rotatably coupled with the first rotating units while the other one of the mounting members is rotatably coupled with the second rotating unit, wherein each of the mounting members has an installation cavity and the two lighting devices are detachably installed in the two installation cavities the two mounting members respectively.

According to another aspect of the present invention, the present invention further provides a manufacturing method of a portable lamp, comprising the following steps:

(a) Rotatably couple two free ends of two extending arms of a first handle body and two free ends of two extending arms of a second handle body respectively through two adjusting units respectively.

(b) Rotatably couple both ends of a rotation shaft coupled with at least one lighting device to the two adjusting units respectively to form the portable lamp.

In one embodiment, according to the above manufacturing method, each of the adjusting units has a first slot and each end of the rotation shaft has a first projection, wherein the two first projections of the rotation shaft are rotatably coupled in the first slots of the two adjusting units respectively.

In one embodiment, according to the above manufacturing method, two positioning units are provided at two ends of the rotation shaft respectively, wherein each of the positioning units comprises a third positioning element and a third resilient element retained between the third positioning element and the rotation shaft, wherein when the first projections of the rotation shaft are respectively mounted on the first slots of the adjusting units, a positioning end of the third positioning element is positioned in a third positioning slot of the respective adjusting unit.

According to one embodiment of the present invention, the step (a) further comprises the following steps:

(a.1) Provide an engaging member to each of the free ends of each of the extending arms of the first handle body.

(a.2) Provide a fastening member to each of the free ends of each of the extending arms of the second handle body.

(a.3) Rotatably couple the engaging members with the fastening members respectively, wherein each of the engaging members and one of the fastening members form an adjusting unit, wherein, in the step (b), both ends of the rotation shaft are respectively and rotatably coupled with the engaging members.

According to one embodiment of the present invention, the step (b) further comprises the following steps:

(b.1) Provide two first rotating units to one of the lighting devices.

(b.2) Provide a second rotating unit to another one of the lighting devices.

(b.3) Rotatably couple the second rotating unit to the first rotating units, wherein each of the first rotating units and the second rotating unit form the rotation shaft.

(b.4) Rotatably couple the first rotating units with the adjusting units respectively.

According to one embodiment of the present invention, the step (b) further comprises the following steps:

(b.1) Provide two first rotating units to one of the lighting devices.

(b.2) Provide a second rotating unit to another one of the lighting devices.

(b.3) Rotatably couple the second rotating unit with the first rotating units, wherein each of the first rotating units and the second rotating unit form the rotation shaft.

(b.4) Rotatably couple the first rotating units with the engaging members to form the adjusting units respectively.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
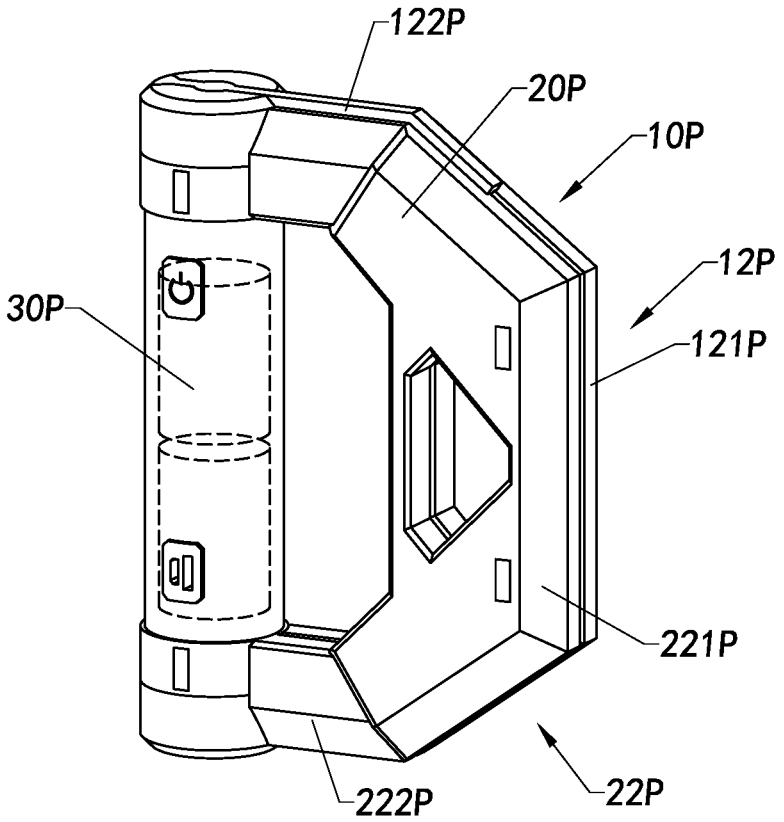
FIG. 1A is a perspective view of a conventional portable lamp.
Figure 1B:
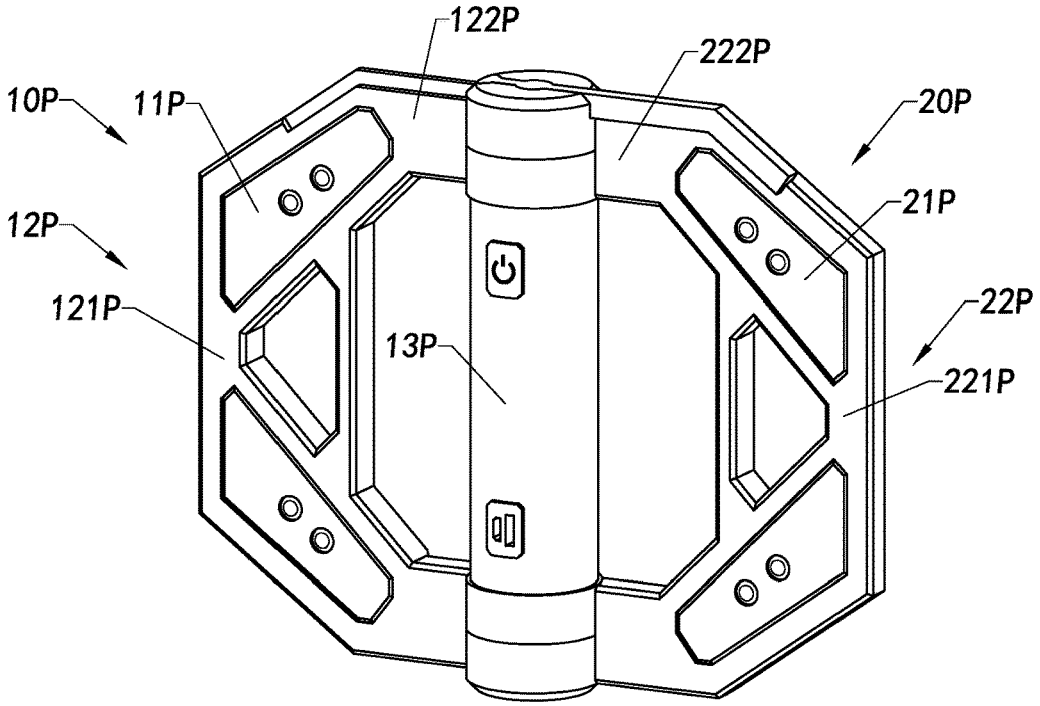
FIG. 1B is a perspective view illustrating an operating state of the conventional portable lamp.
Figure 1C:
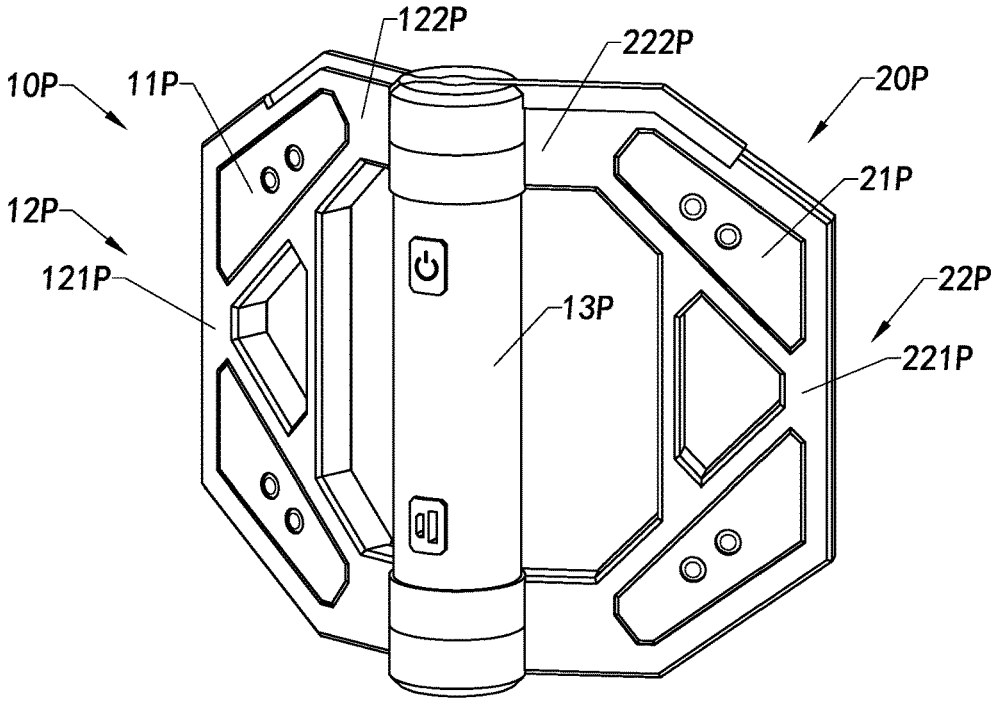
FIG. 1C is a perspective view illustrating another operating state of the conventional portable lamp.

The following description is disclosed to enable any person skilled in the art to make and use the present invention. Preferred embodiments are provided in the following description only as examples and modifications will be apparent to One skilled in the art. The general principles defined in the following description would be applied to other embodiments, alternatives, modifications, equivalents, and applications without departing from the spirit and scope of the present invention.

Referring to FIGS. 2 to 11 of the present invention, a portable lamp according to a preferred embodiment of the present invention is illustrated, wherein the portable lamp comprises at least one lighting device 10, at least one handle body 20 and an adjusting device 30, wherein the adjusting device 30 comprises a rotation shaft 31 and two adjusting units 32. The at least one lighting device 10 is rotatably coupled with the rotation shaft 31 and each of the adjusting units 32 is respectively coupled with the at least one handle body 20, wherein the rotation shaft 31 is rotatably coupled with the two adjusting units 32, so that as the rotation shaft 31 is driven to rotate with respect to the two adjusting units 32, the position and angle of the at least one lighting device 10 is able to be adjusted with respect to the at least one handle body 20, so as to change the radiation direction of the light generated by the at least one lighting device 10. Preferably, the two adjusting units 32 are rotatably coupled with two ends of the rotation shaft 31 coaxially and respectively that ensures a stability of the rotation of the rotation shaft 31 when it is driven to rotate with respect to the two adjusting units 32.

Preferably, according to the preferred embodiment as shown in FIGS. 2 to 11, two lighting devices 10 and two handle bodies 20 are provided, wherein each of the lighting device 10 is rotatably coupled with the rotation shaft 31 and the two adjusting units 32 are respectively coupled with the two handle bodies 20, wherein the two adjusting units 32 are rotatably coupled with two ends of the rotation shaft 31, so that as two adjusting units 32 are driven to rotate with respect to the rotation shaft, the positions and angles of the two lighting devices 10 are able to be adjusted independently with respect to the two handle bodies 20, so as to respectively change the radiation directions of the light beams emitted from the two lighting devices 10. In other words, when the rotation shaft 31 is driven to rotate with respect to the two adjusting units 32, the rotation shaft 31 will drive each of the lighting devices 10 to rotate simultaneously with respect to each of the handle bodies 20, so as to adjust the position and angle of each of the lighting devices 10 with respect to each of the handle bodies 20. More preferably, the position of each of the lighting devices 10 relative to each of the handle bodies 20 can be adjusted for large angle by means of rotation so as to meet the required radiation direction of the light generated by each of the lighting devices 10 of the users. For example, the position of each of the two lighting devices 10 relative to the two handle bodies 20 can be rotated to adjust for 360°.

Furthermore, each of the handle bodies 20 has a turning space 201, wherein the two lighting devices 10 can be rotated in the two turning spaces 201 of the two handle bodies 20 respectively and be retained their positions within the two turning spaces 201 of the two handle bodies 20 respectively. For example, when the two lighting devices 10 are retained to position in the two turning spaces 201 of the two handle bodies 20 respectively, the size of the portable lamp can be reduced, so as to allow the users of the portable lamp to operate, carry and store the portable lamp conveniently.

It is worth mentioning that, according to the preferred embodiment of the portable lamp of the present invention, even when each of the lighting device 10 is held in the turning space 201 of the respective handle body 20, the lighting devices 10 are still capable of emitting light. For example, the lighting devices 10 can generate illuminating light for illumination of the operation environment. The portable lamp of the present invention is provided in such a manner that its users are allowed to conveniently select the manner of using the portable lighting device according to their needs.

Each of the handle bodies 20 comprises a handle element 21 and two extending arms 22 extended from two ends of the handle element 21 respectively, wherein each of the turning spaces 201 is formed in the space defined between the handle element 21 and the two extending arms 22. Preferably, the two extending arms 22 are extended integrally and bent at both ends of the handle element 21 respectively to form a "C" shape or a "U" shape handle body 20 while the turning space 201 thereof is formed between the handle element 21 and the two extending arms 22.

Each of the extending arms 22 of the handle body 20 has a free end 221 and the two adjusting units 32 of the adjusting device 30 are respectively coupled at the two free ends 221 of the two extending arms 22 of each of the handle bodies 20, wherein both ends of the rotation shaft 31 are respectively and rotatably coupled with the two adjusting units 32, ensuring the two lighting devices 10 coupled with the rotation shaft 31 can be rotated about the rotation shaft 31 within the two turning spaces 201 of the two handle bodies 20 respectively, as shown in Fig. and FIGS. 12A-12F, and be maintained in position within the turning spaces 201 of the handle bodies 20.

Referring to FIGS. 3-9, each of the adjusting units 32 forms a ring shape first slot 320 and each of the two ends of the rotation shaft 31 forms a ring shape first projection 310, wherein the two first projections 310 of the rotation shaft 31 are arranged to be rotatably engaged with the two first slots 320 of the two adjusting units 32 respectively to coaxially and rotatably mount the rotation shaft 31 between the two adjusting units 32, such that when the rotation shaft 31 is driven to rotate with respect to the adjusting units 32, the two first projections 310 of the rotation shaft 31 respectively rotate within the two first slots 320 of the two adjusting units 32 while the two first projections 310 of the rotation shaft 31 are retained in the two first slot 320 of the adjusting units 32 respectively to prevent the rotation shaft 31 from disengaging with each of the adjusting units 32.

In other words, when the two first projections 310 of the rotation shaft 31 are respectively rotating within the two first slots 320 of the adjusting units 32 while the first projections 310 of the rotation shaft 31 are maintained being held in the first slots 320 of the adjusting units 32 respectively, the positions and angles of the lighting devices 10 are adjusted in relative to the handle bodies 20.

In an alternative mode of the above preferred embodiment of the portable lamp of the present invention, each of the adjusting units 32 may alternatively provide the ring-shaped first projections 310 and each end of the rotation shaft 31 may alternatively provide the ring-shaped first slot 320, wherein the first projections 310 of the two adjusting units 32 are rotatably engaged two the two first slots 320 of the rotation shaft 31 respectively so as to rotatably couple the two ends of the rotation shaft 31 with the two first adjusting units 32 respectively.

Preferably, two handle bodies 20 are comprised in the portable lamp, wherein the relative positions and angles of the two handle bodies 20 are adjustable that allows the user to select an operating state of the portable lamp to use. In particular, the two handle bodies 20 can be adjusted to an unfolded state and a folded state, and the two handle bodies 20 are able to be adjusted by rotation to switch between the unfolded state and the folded state. In other words, the two handle bodies 20 may be either maintained in the unfolded state or in the folded state according to the selection as needed.

It is appreciated that, whether the two handle bodies 20 are in the unfolded state or in the folded state, each of the lighting devices 10 is arranged to be able to provide light. For example, each of the lighting devices 10 can provides illuminating light for illumination of the operation environment. In other words, the difference between the two handle bodies 20 being in the unfolded state or being in the folded state is that the user can select different states to use the portable lamp. That is, the operating state of each of the lighting devices 10 of the portable lamp does not be limited by the state of the handle bodies 20. For example, even if the two handle bodies 20 are folded up to overlap with each other where the two handle bodies 20 are in the folded state, each of the lighting devices 10 can still provide light that greatly increases the flexibility of the portable lamp in use.

Figure 12A:
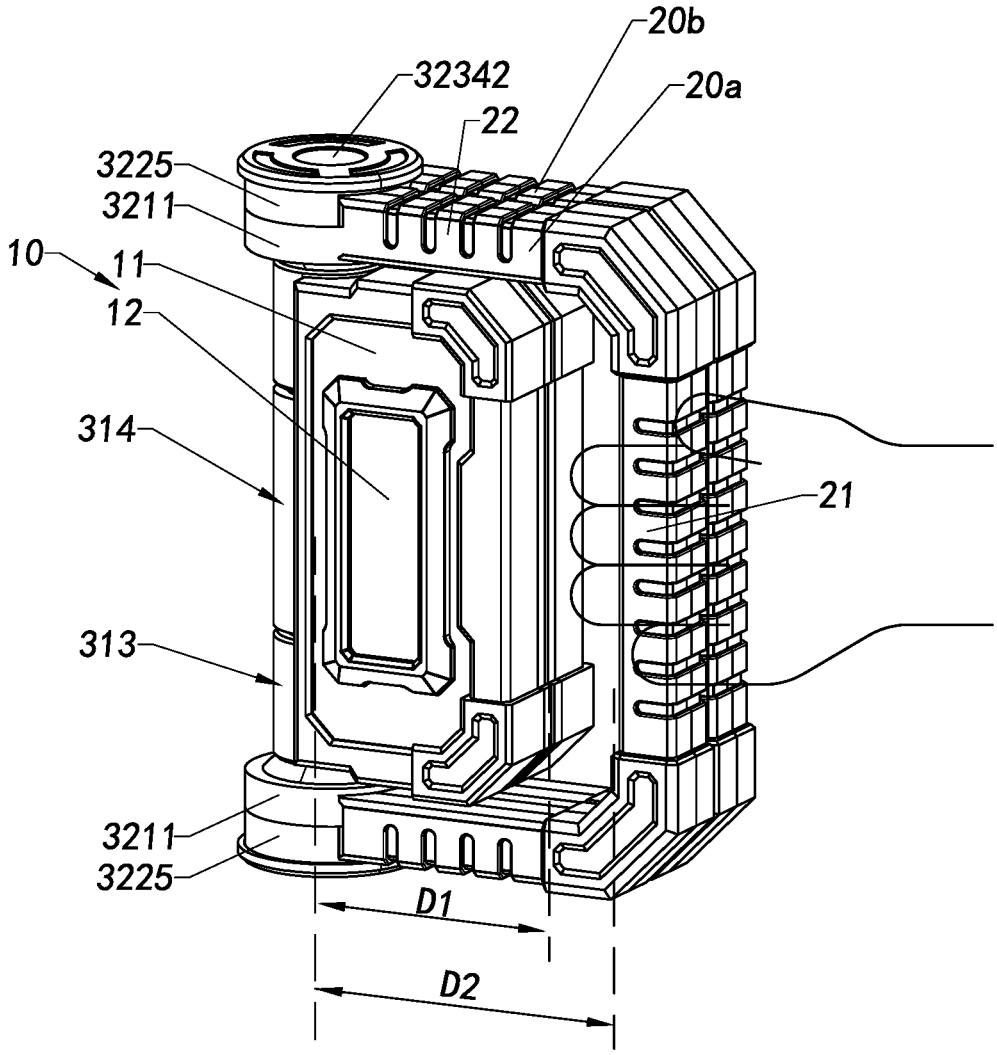
FIG. 12A is a schematic view illustrating an operating state of the portable lamp according to the above preferred embodiment of the present invention.
Figure 12B:
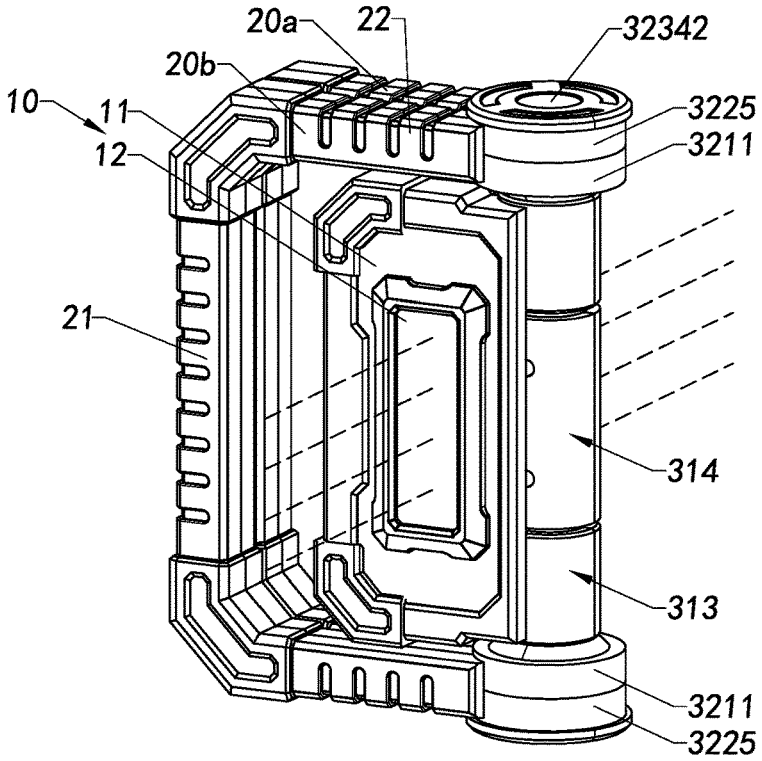
FIG. 12B is a schematic view illustrating another operating state of the portable lamp according to the above preferred embodiment of the present invention.
Figure 12C:
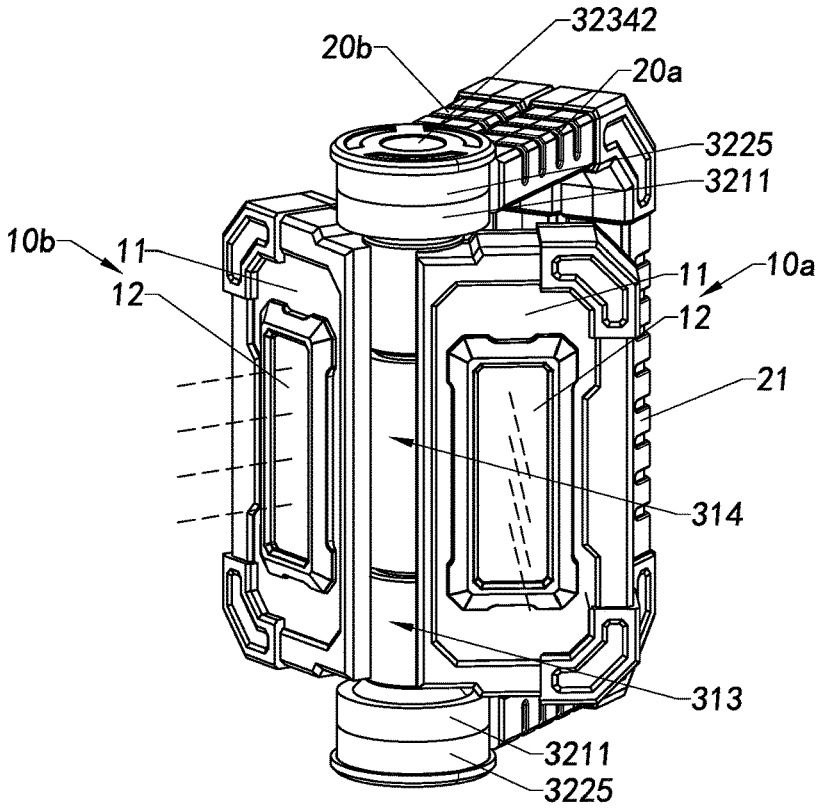
FIG. 12C is a schematic view illustrating another operating state of the portable lamp according to the above preferred embodiment of the present invention.

It is also worth mentioning that, according to the preferred embodiment of the portable lamp of the present invention, when the two handle bodies 20 are in the folded state, the handle elements 21 of the two handle bodies 20 are overlapped side by side with each other, as shown in FIGS. 12A-12D. Correspondingly, when the two handle bodies 20 are in the unfolded state, the handle elements 21 of the two handle bodies 20 are separated from each other, as shown in FIGS. 12E-12F. One skilled in the art should understand that, during the two handle bodies 20 are in the unfolded state, a separation distance between the handle elements 21 of the two handle bodies 20 is not limited and an angle between the two handle bodies 20 is larger than zero degree.

As shown in FIGS. 4 to 7 of the drawings of the present invention, each of the adjusting units 32 comprises an engaging member 321, a fastening member 322, and a first adjusting member 323, wherein the two engaging members 321 of the two adjusting units 32 are respectively provided at the free ends 221 of the two extending arms 22 of one of the handle bodies 20, and the two fastening members 322 of the two adjusting units 32 are respectively provided at the free ends 221 of the two extending arms 22 of the other one of the handle bodies 20. The engaging member 321 and the fastening member 322 of each of the adjusting units 32 are mounted together through the first adjusting member 323 in such a manner that the first adjusting member 323 allows the fastening member 322 to be rotated with respect to the engaging member 321, such that the two the handle bodies 20 can be moved in relative to each other and switched between the unfolded state and the folded state.

Two ends of the rotation shaft 31 are rotatably coupled with the two engaging members 321 of the two adjusting units 32 respectively. Specifically, the engaging member 321 of each of the adjusting units 32 forms the first slot 320, wherein the first projections 310 of the rotation shaft 31 are rotatably engaged with the two first slots 320 of the two engaging members 321 of the two adjusting units 32 respectively so as to coaxially and rotatably couple the two adjusting units 32 at the two ends of the rotation shaft 31 through the two engaging members 321 of the two adjusting units 32.

It is worth mentioning that, in order to facilitate the illustration of the features and advantages of the portable lamp of the present invention, one of the handle bodies 20 is defined as a first handle body 20*a* and the other one of the handle bodies 20 is defined as a second handle body 20*b*. Accordingly, the two engaging members 321 of the two adjusting units 32 are provided at the two free ends 221 of the two extending arms 22 of the first handle body 20*a*. Correspondingly, the two fastening members 322 of the two adjusting units 32 are provided at the two free ends 221 of the two extending arms 22 of the second handle body 20*b*.

Preferably, the two engaging members 321 of the two adjusting units 32 are integrally extended from the two free ends 221 of the two extending arms 22 of the first handle body 20*a*. The two fastening members 322 of the two adjusting units 32 are integrally extended from the two free end 221 of the two extending arms 22 of the second handle body 20*b*.

Furthermore, referring to FIG. 3 to FIG. 7, each of the engaging members 321 of each of the adjusting units 32 comprises an engaging body 3211, an engaging connection portion 3212 and an engaging blocking portion 3213, wherein the circular engaging body 3211 is integrally formed at the free end 221 of the respective extending arm 22 of the first handle body 20*a*, one end of the circular engaging connection portion 3212 is formed on a side of the engaging body 3211, and the circular engaging blocking portion 3213 is provided on another end of the engaging connection portion 3212, wherein the engaging connection portion 3212 has a size smaller than that of the engaging body 3211 and the engaging blocking portion 3213, so that the first slot 320 which is a ring-shaped engaging slot formed in the engaging connection portion 3212 is defined between the engaging body 3211 and engaging blocking portion 3213, as shown in FIG. 3 to FIG. 7.

Preferably, the two engaging bodies 3211 are integrally extended from the two free end 221 of the two extending arms 22 of the first handle and body 20*a* respectively, wherein one end of the engaging connection portion 3212 is integrally extended from the side portion of the respective engaging body 3211 and the engaging blocking portion 3213 is integrally extended from the other end of the respective engaging connection portion 3212.

Figure 8:
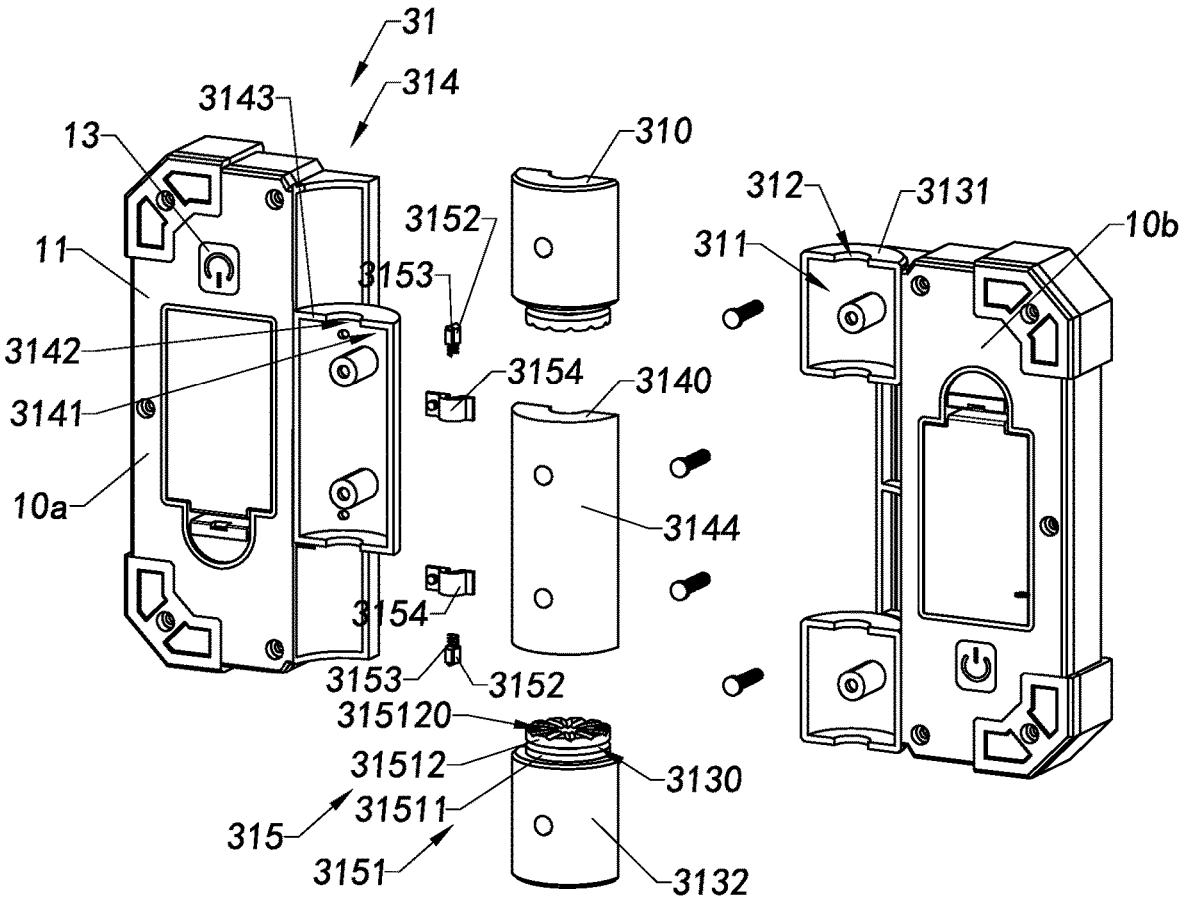
FIG. 8 is an exploded view of the connection position of the rotation shaft and the lighting device of the portable lamp according to the above preferred embodiment of the invention.
Figure 9:
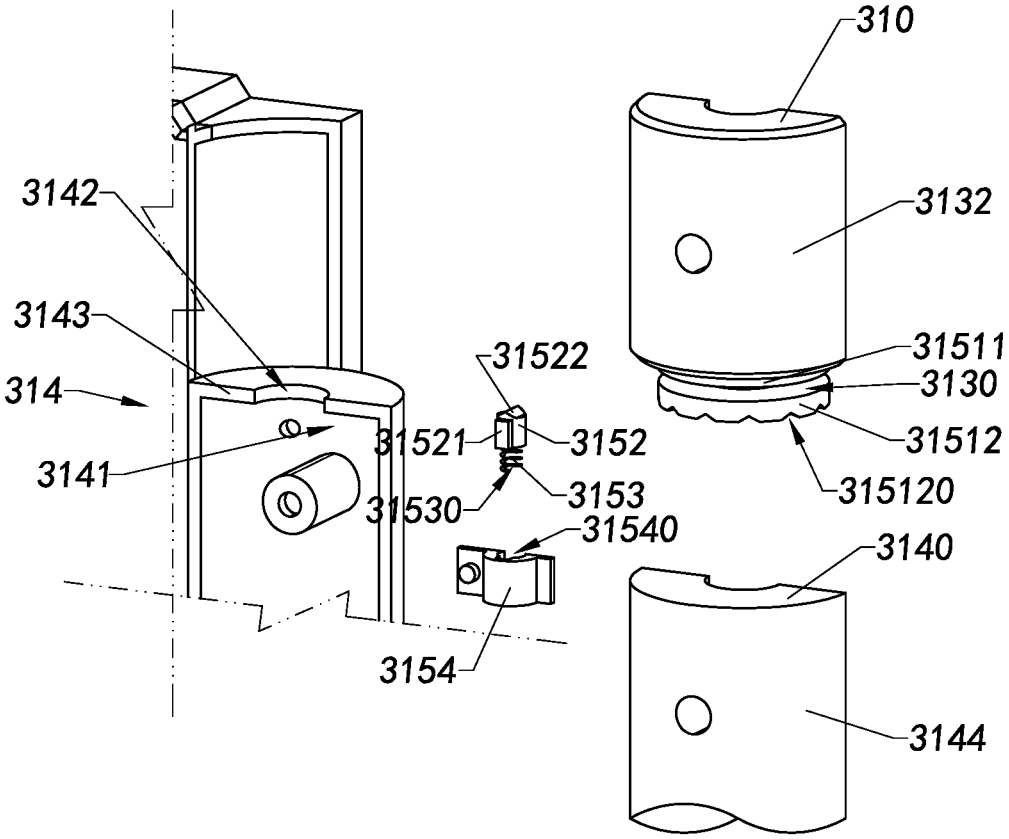
FIG. 9 is a partial enlarged view of FIG. 8.
Figure 10:
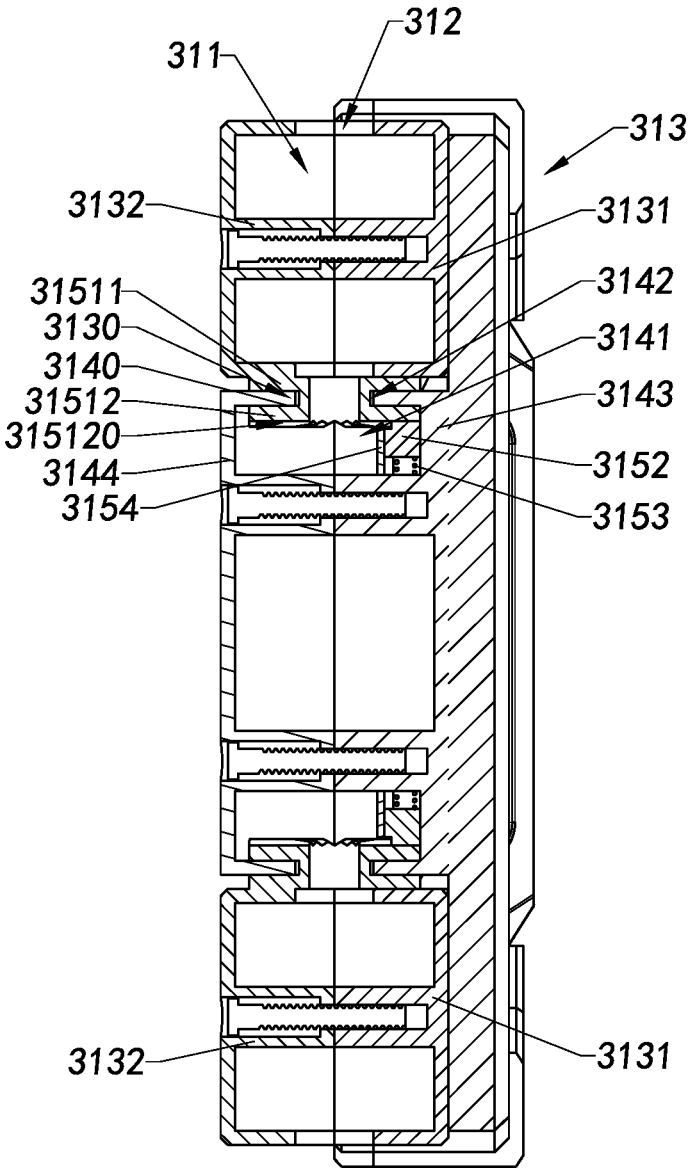
FIG. 10 is a partial sectional view illustrating the connection position between the rotation shaft and the lighting device of the portable lamp according to the above preferred embodiment of the present invention.
Figure 11:
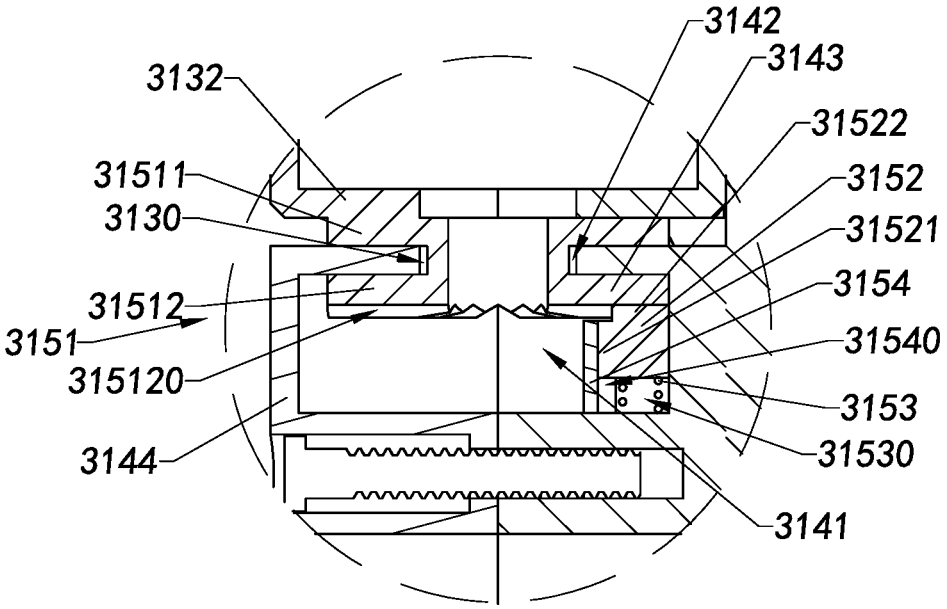
FIG. 11 is a partial enlarged view of FIG. 10.

Two end portions of the rotation shaft 31 each has a first receiving cavity 311 formed therein and a first channel 312 communicating the first receiving cavity 311 and outside, as shown in FIG. 8 to FIG. 10, wherein an end wall surrounding and defining the first channel 312 forms the first projection 310. In other words, the first projection 310 has a ring shape and the first channel 312 is a center hole formed in the first projections 310.

The coupling of the two end portions of the rotation shaft 31 with the two adjusting units 32 respectively is accomplished by retaining the two engaging blocking portions 3213 of the two engaging member 321 of the two adjusting units 32 in the two first receiving cavities 311 of the two end portions of the rotation shaft 31 respectively while the two engaging bodies 3211 are held outside of the end portions of the rotation shaft 31 respectively, wherein the two engaging connection portions 3212 are retained in the two first channels 312 of the rotation shaft 31 respectively while the two first projections 310 of the rotation shaft 31 are rotatably retained in the two first slots 320 of the two engaging members 321 of the two adjusting units 32 respectively, such that the two engaging members 321 of the two adjusting units 32 are rotatably connected with the two ends of the rotation shaft 31 coaxially.

Preferably, a thickness of the first slot 320 of each of the engaging members 321 matches, that is preferred to be equal to or slighting larger than, a thickness of each of the first projections 310 of the rotation shaft 31. Also, a width size between the engaging body 3211 and the engaging blocking portion 3213 of each of the engaging members 321 matches, that is preferably equal to or slightly larger than, the thickness each of the first projections 310 of the rotation shaft 31, so as to avoid adverse effect caused by the sloshing of the rotation shaft 31 with respect to the engaging member 321 to ensure the stability and reliability of the portable lamp.

More preferably, the engaging connection portion 3212 of each of the engaging members 321 is in cylindrical shape, wherein each of the engaging connection portions 3212 has a circular cross sectional shape and each of the first channels 312 of the rotation shaft 31 is a circular opening, so that when the engaging members 321 of the adjusting units 32 are mounted at two ends of the rotation shaft 31, a central axis of the rotation shaft 31 and a central axis of each of the engaging members 321 are coincident. In addition, no matter the rotation shaft 31 and the engaging members 321 of the adjusting units 32 are rotated for whatever angle with respect to each other, the rotation shaft 31 and the engaging members 321 of the adjusting units 32 are rotated coaxially along a common rotation axis of the rotation shaft 31 and the two adjusting units 32 so as to ensure the stability and reliability of the portable lamp during operation.

Figure 5A:
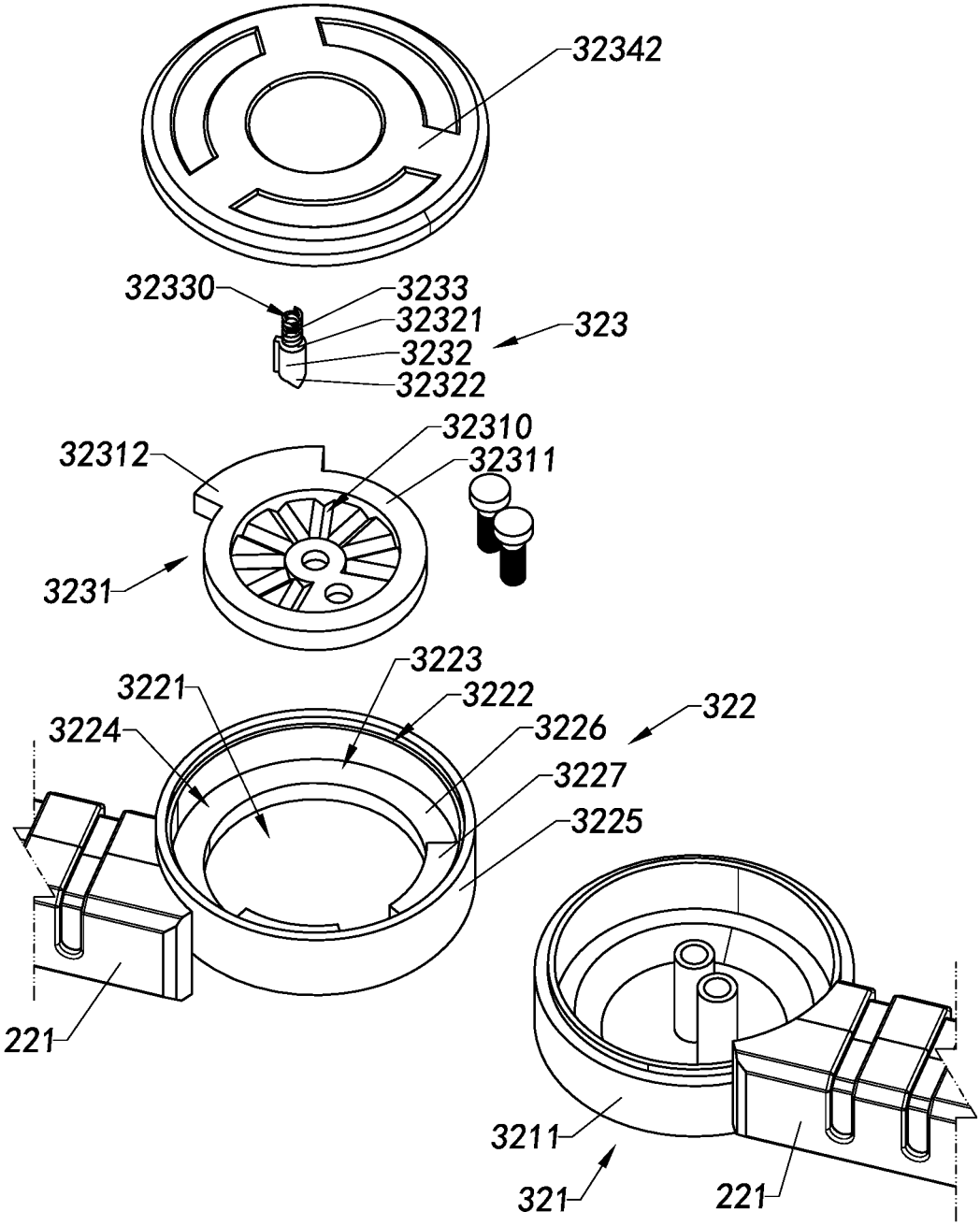
FIG. 5A is a partial enlarged view of FIG. 4.
Figure 5B:
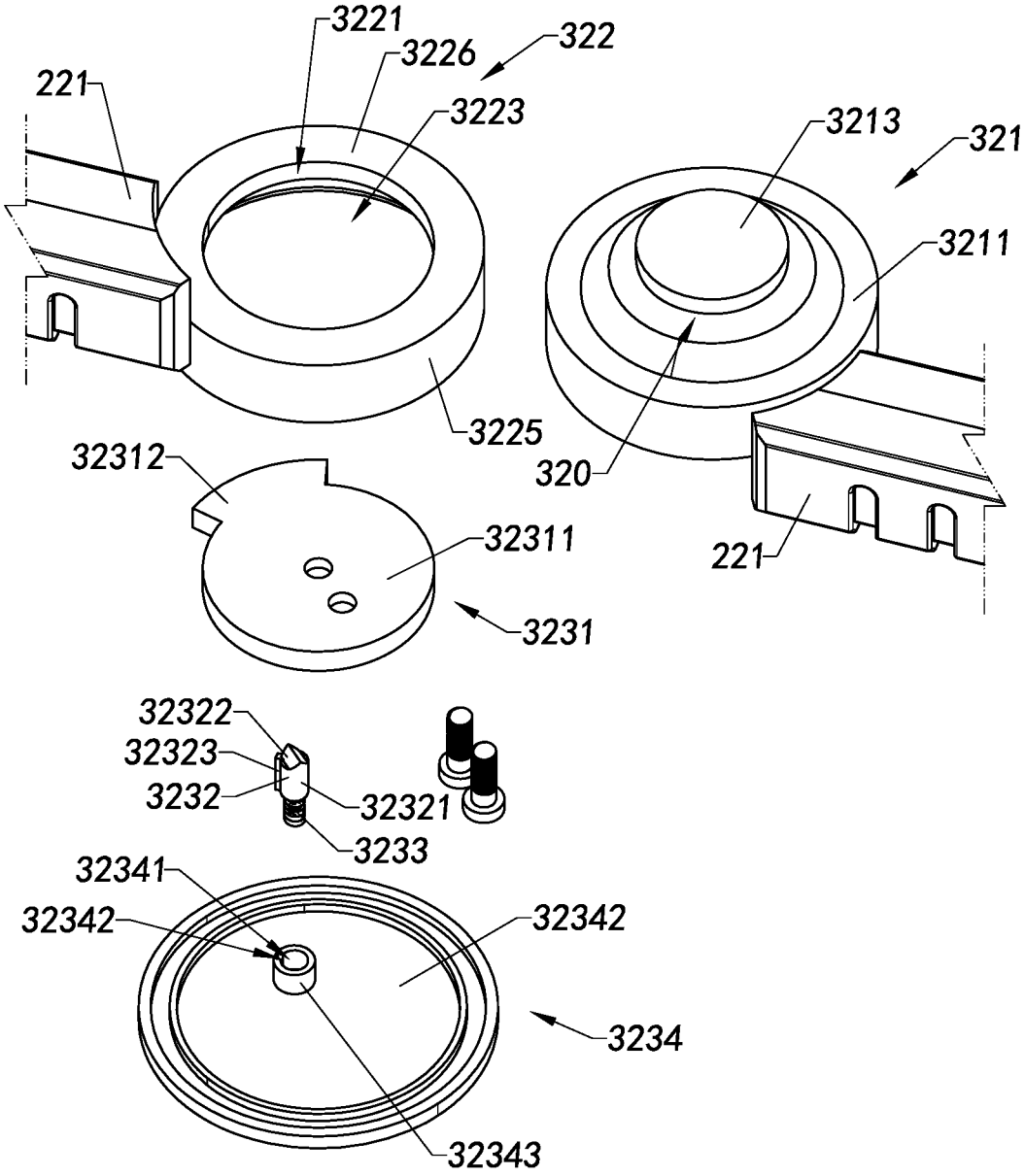
FIG. 5B is another partial sectional view of FIG. 4.
Figure 6:
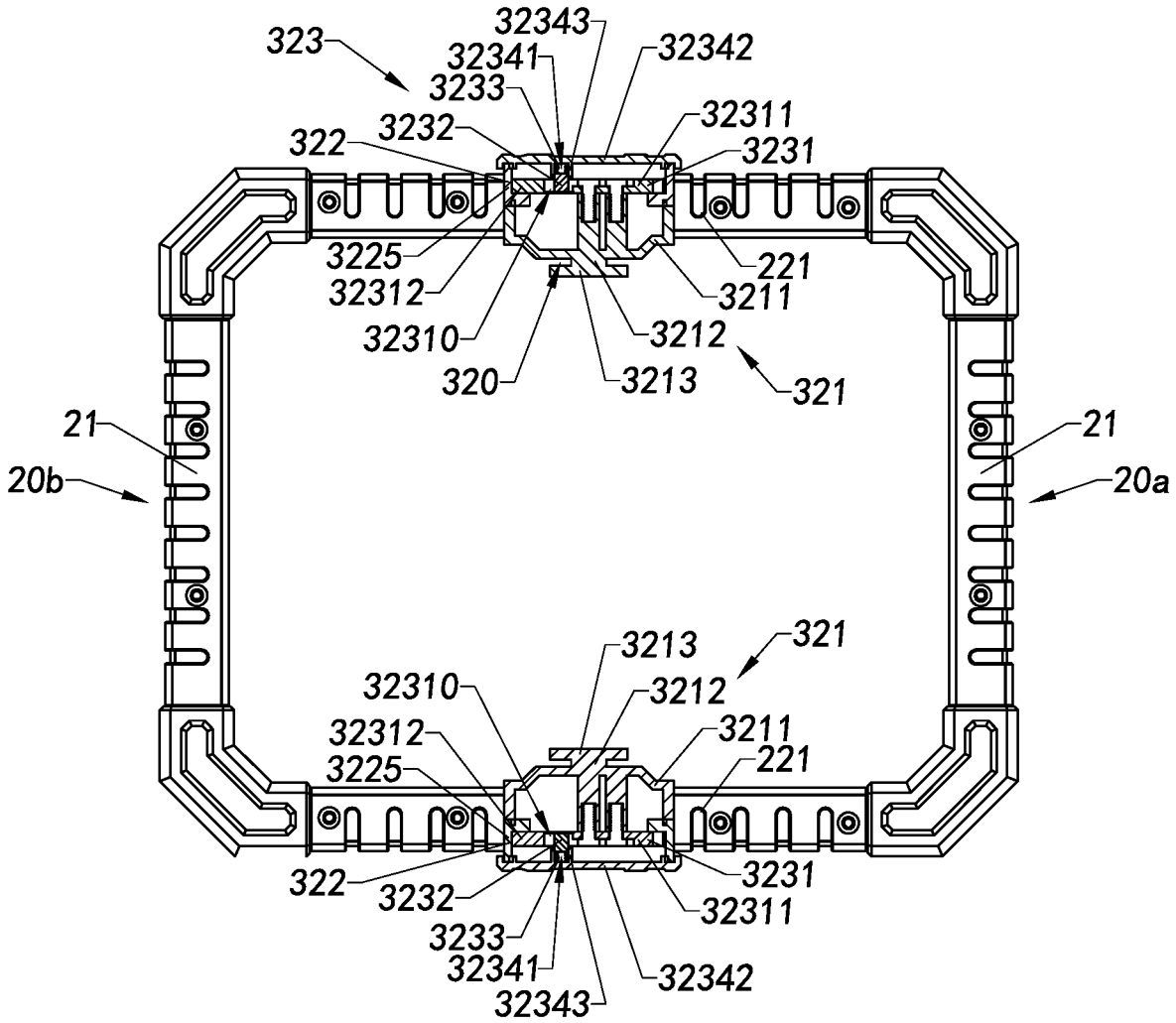
FIG. 6 is a partial sectional view of the connection position between the handle body and the adjusting unit of the portable lamp according to the above preferred embodiment of the present invention.
Figure 7:
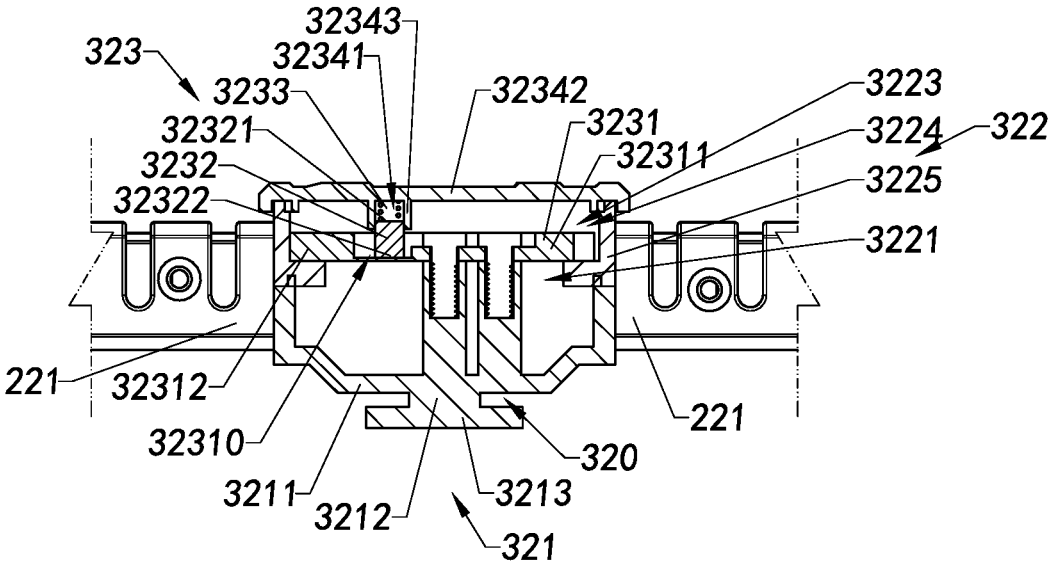
FIG. 7 is a partial enlarged view of FIG. 6.

Referring to FIG. 5A and FIG. 5B, the fastening member 322 of each of the adjusting units 32 has a first opening 3221, a second opening 3222 and a fastening cavity 3223 between the first opening 3221 and the second opening 3222. The first opening 3221 and the second opening 3221 are formed at two sides of the fastening member 322 to communicate the fastening cavity 3223 with outside of the fastening member 322, wherein a diameter size of the first opening 3221 is smaller than a diameter size of the fastening cavity 3223.

The first adjusting members 323 of each of the adjusting units 32 comprises a first adjusting body 3231, a first positioning element 3232, a first resilient element 3233, and a covering element 3234.

The first adjusting body 3231 has a set of first positioning slots 32310 radially, intervally and spacedly formed therethrough, wherein the first adjusting body 3231 is rotatably disposed in the fastening cavity 3223 of the fastening member 322. The adjusting body 3231 is connected to the engaging body 3211 of the engaging member 321 via the first opening 3221 of the fastening member 322 and each of the first positioning slots 32310 of the first adjusting body 3231 faces the second opening 3222 of the fastening member 322. Preferably, the first adjusting body 3231 is screwed to the engaging body 3211 of the engaging member 321 by one or more screws via the first opening 3221 of the fastening member 322, such that when the engaging member 321 is rotated relative to the fastening member 322, the first adjusting body 3231 of the first adjusting member 323 rotates simultaneously within the fastening cavity 3223 of the fastening member 322.

The covering element 3234 has a first guiding chamber 32341. The first resilient element 3233 is disposed in the first guiding chamber 32341 of the covering element 3234. The first positioning element 3232 has a first mounting end 32321 and a first positioning end 32322 corresponding to the first mounting end 32321, wherein the first positioning element 3232 of the first mounting end 32321 is movably mounted in the first guiding chamber 32341 of the covering element 3234 while the first positioning element 3232 of the first mounting end 32321 is interacting with the first resilient element 3233. The first positioning end 32322 of the first positioning element 3232 is extended to expose outside the first guiding chamber 32341 of the covering element 3234, such that the first positioning end 32322 of the first positioning element 3232 is able to be positioned at different positions in the first positioning slot 32310 of the first adjusting body 3231.

The covering element 3234 is mounted on the fastening member 322. More specifically, the covering element 3234 is retained and positioned at the second opening 3222 of the fastening member 322. The first positioning element 3232 is held and retained in the fastening cavity 3223 of the fastening member 322, and that the covering element 3234 and the first resilient element 3233 are equipped with each other to retain the first positioning end 32322 of the first positioning element 3232 in one of the first positioning slots 32310 of the first adjusting body 3231. Preferably, the covering element 3234 sealedly covers the second opening 3222 of the fastening member 322. More preferably, the covering element 3234 is bonded by glue or other adhesive with the fastening member 322 so as to seal the second opening 3222 of the fastening member 322.

It is understood that, according to the preferred embodiment of the portable lamp of the present invention, the relative position of the first positioning element 3232 and the fastening member 322 remains unchanged. In other words, the relative position of the first positioning element 3232 and the second handle body 20*b* remains unchanged.

Furthermore, the first adjusting body 3231 comprises an adjusting body portion 32311 and a limiting portion 32312 integrally extended from a side portion of the adjusting body portion 32311, wherein the adjusting body portion 32311 forms the first positioning slots 32310 and the adjusting body portion 32311 of the first adjusting body 3231 is connected to the engaging body 3211 of the engaging member 321 via the first opening 3221 of the fastening member 322. Both the limiting portion 32312 and the adjusting body portion 32311 are retained in the fastening cavity 3223 of the fastening member 322 and the limiting portion 32312 is used to limit the rotating position of the adjusting body portion 32311 within the fastening cavity 3223 of the fastening member 322.

The fastening member 322 further has a limiting slot 3224 communicating with the fastening cavity 3223, wherein the limiting portion 32312 of the first adjusting body 3231 is movably disposed in the limiting slot 3224 of the fastening member 322, wherein limiting slot 3224 of the fastening member 322 is used to limit the rotating position of the limiting portion 32312 within fastening cavity 3223.

The fastening member 322 further comprises a fastening ring 3225, a limiting ring 3226 and at least one limiting element 3227, wherein the fastening ring 3225 is integrally formed at the free end 221 of each of the extending arms 22 of the second handle body 20*b*. And, the fastening ring 3225 defines the fastening cavity 3223 therein, wherein the holding ring 3226 is integrally and inwardly extended from one side of the fastening ring 3225 defining the first opening 3221 in a central position thereof, so that the first opening 3221 and the second opening 3222 are respectively formed at two sides of the fastening member 322 to communicate the fastening cavity 3223 with outside. The positioning element 3227 is integrally formed either on an inner wall of the fastening ring 3225 or on an inner side of the limiting ring 3226, or that the limiting element 3227 is integrally protruded both on the inner wall of the limiting ring 3225 and on the inner side of the limiting ring 3226, so that the limiting slot 3224 is defined between the limiting element 3227, the limiting ring 3226 and the fastening ring 3225, while the limiting slot 3224 is communicating with the fastening cavity 3223.

When the first adjusting body 3231 is disposed in the fastening member 322, the adjusting body portion 32311 of the first adjusting body 3231 is stopped and supported by the holding ring 3226 of the fastening member 322 in order to be retained in the fastening cavity 3223, wherein the adjusting body portion 32311 can be connected to the engaging body 3211 of the engaging member 321 via the first opening 3221. The limiting portion 32312 of the first adjusting body 3231 is movably retained in the limiting slot 3224 of the fastening member 322 for restricting the rotating position of the adjusting body portion 32311 within the fastening cavity 3223 of the fastening member 322.

The covering element 3234 comprises a covering portion 32342 and a leading rod 32343 integrally extended from one side of the covering portion 32342, wherein the first guiding chamber 32341 is coaxially formed in the leading rod 32343 and the first resilient element 3233 and the first mounting end 32321 of the first positioning element 3232 are respectively mounted by the leading rod 32343 of the covering element 3234 to be held in the first guiding chamber 32341. When the covering element 3234 is mounted on the fastening member 322, the covering portion 32342 covers the second opening 3222 of the fastening member 322. The leading rod 32343 and the first positioning element 3232 are held in the fastening cavity 3223 of the fastening member 322, and the first positioning end 32322 of the first positioning element 3232 is positioned in one of the first positioning slots 32310 of the first adjusting body 3231.

Preferably, the first resilient element 3233 is embodied as a compression spring, and the first resilient element 3233 has a first arranging space 32330, wherein the first mounting end 32321 of the first positioning element 3232 is mounted in the first arranging space 32330 of the first resilient element 3233 which can prevent the first positioning element 3232 from being detached with the first resilient element 3233. When the first positioning element 3232 moves along the first guiding chamber 32341 of the covering element 3234 towards the covering portion 32342, the first positioning element 3232 applies a force on the first resilient element 3233 to compress the first resilient element 3233 to a compressed state. At this time, the first resilient element 3233 accumulates elastic energy, wherein as the external force applied on the first positioning element 3232 is released, the first resilient element 3233 returns to its initial state and drives the first positioning element 3232 to move along the first guiding chamber 32341 of the covering element 3234 in a direction away from the covering portion 32342.

Preferably, the leading rod 32343 of the covering element 3234 has a leading slot 32344 extended along the height of the leading rod 32343 and communicated with the first guiding chamber 32341. A side of the first positioning element 3232 is provided with a leading projection 32323, wherein the leading projection 32323 of the first positioning element 3232 is movably disposed in one of the leading slots 32344 of the covering element 3234, such that the first positioning element 3232 can be prevented from rotating within the first guiding chamber 32341 of the covering element 3234 for ensuring the reliability and stability of the portable lamp in use.

Referring to FIGS. 2 to 10, the number of the lighting devices 10 of the portable lamp may be two. The relative positions and angles of the two lighting devices 10 can be adjusted to change the radiation direction of each of the lighting devices 10.

For example, during an operating state of the portable lamp according to the preferred embodiment of the present invention, the light emitting directions generated by the two lighting devices 10 define an angle therebetween, having an angular value greater than 90°, so that the portable lamp can be used to provide lighting for larger area in the operating environment. In another operating state of the portable lamp according to the preferred embodiment of the present invention, the two lighting devices 10 can also provide light in the opposite directions respectively at the same time. In another operating state of the portable lamp according to the preferred embodiment of the present invention, the two lighting devices 10 can also provide light in the same direction, so that the light sources provided by the two lighting devices 10 are concentrated to enhance the lighting intensity of the portable lamp.

It is worth mentioning that, in order to facilitate the description of the features and advantages of the portable lamp of the present invention, one of the lighting devices 10 is defined as a first lighting device 10*a*, and the other lighting device 10 is defined as a second lighting device 10*b*, wherein the first lighting device 10*a* and the second lighting device 10*b* are respectively coupled with the rotation shaft 31 while the relative angle of the first lighting device 10*a* and the second lighting device 10*b* can be adjusted accordingly. For example, the first lighting device 10*a* and the second lighting device 10*b* can be adjusted to a back-to-back condition, as shown in FIGS. 12A and 12B, wherein the first lighting device 10*a* and the second lighting device 10*b* are overlapped to provide light towards two opposite directions.

Figure 12D:
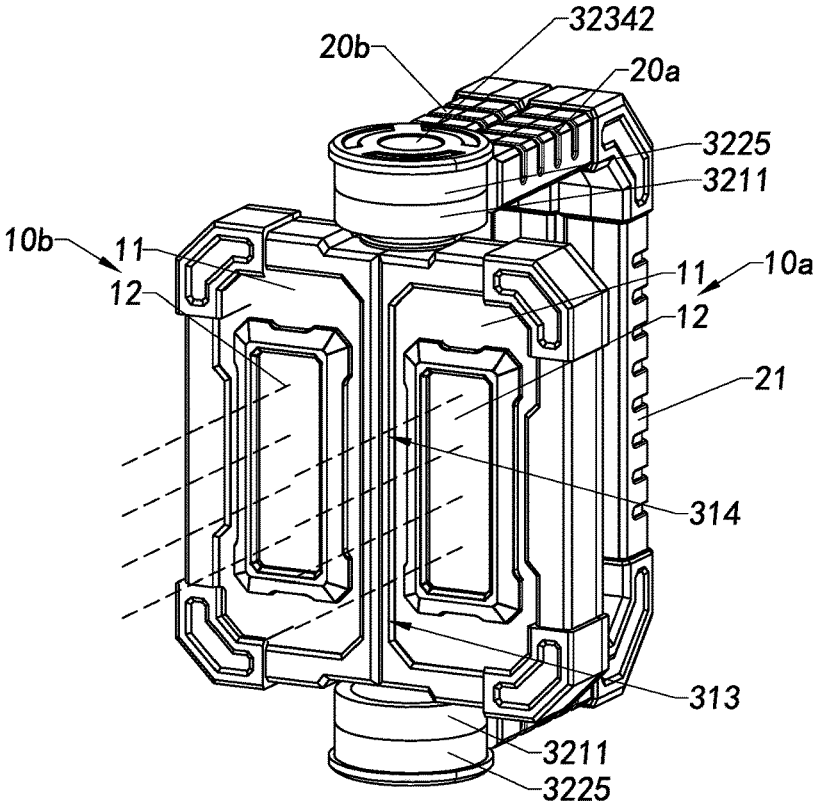
FIG. 12D is a schematic view illustrating another operating state of the portable lamp according to the above preferred embodiment of the present invention.
Figure 12E:
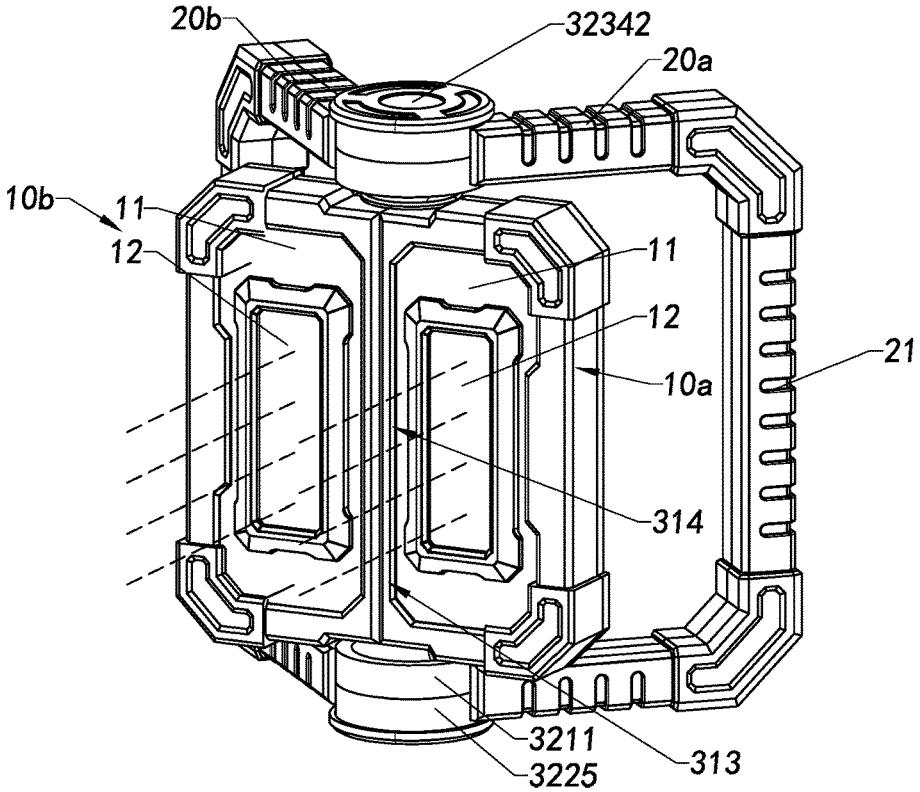
FIG. 12E is a schematic view illustrating another operating state of the portable lamp according to the above preferred embodiment of the present invention.
Figure 12F:
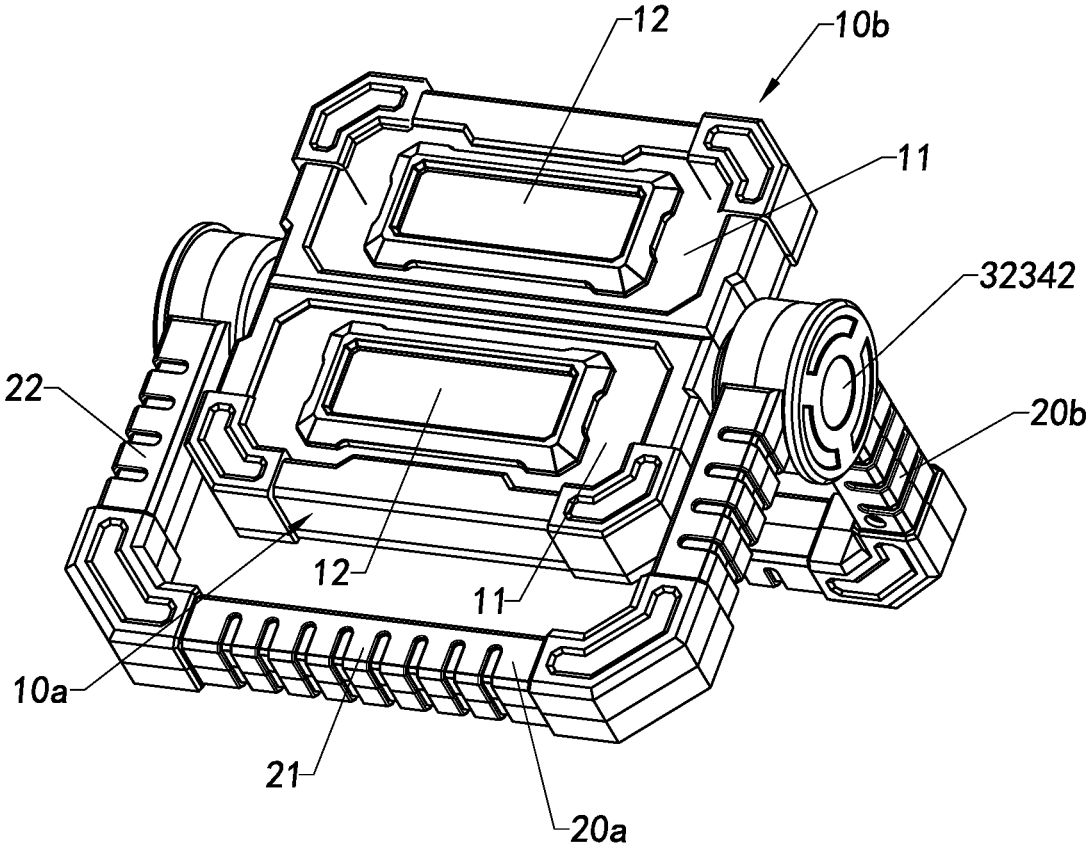
FIG. 12F is a schematic view illustrating another operating state of the portable lamp according to the above preferred embodiment of the present invention.

Alternatively, the first lighting device 10*a* and the second lighting device 10*b* can be adjusted in a shoulder to shoulder condition, as shown in FIGS. 12D-12F, wherein both the first lighting device 10*a* and the second lighting device 10*b* provide light towards the same direction.

Furthermore, as shown in FIG. 8 to FIG. 11, the rotation shaft 31 comprises two first rotating units 313, a second rotating unit 314, and two second adjusting units 315, wherein the two first rotating units 313 are respectively provided at two ends of the first lighting device 10*a*, the second rotating unit 314 is provided at a middle portion of the second lighting device 10*b*, and the second rotating unit 314 is rotatably provided between the two first rotating units 313. The two second adjusting units 315 are used to respectively connect the ends of the two first rotating units 313 with the two ends of second rotating unit 314, wherein the two second adjustment units 315 respectively maintain the positions of the first rotating units 313 and the second rotating unit 314 after being adjusted.

Specifically, each of the first rotating units 313 has the first engaging projection 310, the first receiving cavity 311 and the first channel 312, wherein the engaging blocking portion 3213 of the engaging member 321 is held and retained in the first receiving cavity 311 of the respective first rotating unit 313 of the rotation shaft 31, while the engaging body 3211 is held outside the respective first rotating unit 313, the engaging connection portion 3212 is held and retained in the first channel 312 of the first rotating unit 313, and the first projection 310 of the first rotating unit 313 is held and retained in the first slot 320 of the engaging member 321, such that the engaging member 321 and the first rotating units 313 are rotatably connected.

The second rotating unit 314 comprises two second projections 3140 and has a second receiving cavity 3141 and two second channels 3142, wherein the two second channels 3142 are connected with two ends of the second rotating unit 314 to communicate the second receiving cavity 3141 with outside, and the second projections 3140 are arranged corresponding to the second channels 3142 respectively. In other words, each of the second projections 3140 is in ring-shaped to define each of the second channels 3142 between the second projections 3140. In addition, each of the second channels 3142 of the second rotating unit 314 is facing towards the respective first rotating unit 313.

Each of the second adjustment units 315 comprises a second adjusting body 3151, a second positioning element 3152, a second resilient element 3153, and a holding element 3154.

The second adjusting body 3151 is provided at the respective first rotating unit 313 and a second slot 3130 is formed between the second adjusting body 3151 and the respective first rotating unit 313. Preferably, the second adjusting body 3151 has an adjusting connection portion 31511 and an adjusting blocking portion 31512 extending from one end of the adjusting connection portion 31511, wherein the other end of the second adjusting body 3151 is provided at the respective first rotating unit 313, wherein a size of the adjusting connection portion 31511 is smaller than a size of each of the first rotating units 313 and a size of the adjusting blocking portion 31512, defining the second slot 3130 between the first rotating units 313 and the adjusting blocking portion 31512.

The adjusting blocking portion 31512 of the second adjusting body 3151 is held and retained in the second receiving cavity 3141 of the second rotating unit 314, and the first rotating units 313 is held and retained outside the second rotating unit 314. The adjusting connection portion 31511 is held and retained in the second channel 3142 while the second projection 3140 is held and retained in the second slot 3130, such that the second rotating unit 314 is rotatably coupled with the respective first rotating unit 313.

Preferably, a thickness of the second projection 3140 is preferably the same as a size of the second slot 3130, so as to prevent adverse effect caused by shaking of the second rotating unit 314 with respect to each of the first rotating units 313 to ensure the stability and reliability of the portable lamp in use.

It is worth mentioning that, after the first rotating units 313 and the second rotating unit 314 are mounted together, the adjusting blocking portion 31512 of the second adjusting body 3151 is held and retained in the second receiving cavity 3141 of the second rotating unit 314. Furthermore, the adjusting blocking portion 31512 of the second adjusting body 3151 has a set of second positioning slots 315120 formed intervally, radially and spacedly with each other and communicated with the second receiving cavity 3141.

Each of the limiting elements 3154 is disposed in the second rotating unit 314. A second leading cavity 31540 is formed between the holding element 3154 and the second rotating unit 314 and the second resilient element 3153 is disposed within the second leading cavity 31540. Selectively, in other alternative mode of the preferred embodiment of the portable lamp of the present invention, the second leading cavity 31540 may be separately formed in the holding element 3154. That is the holding element 3154 has the second leading cavity 31540 therein.

The second positioning element 3152 has a second mounting end 31521 and a second positioning end 31522 correspond to the second mounting end 31521, wherein the second mounting end 31521 of the second positioning element 3152 is movably mounted in the second leading cavity 31540 while the second mounting end 31521 of the second positioning element 3152 is interacting with the second resilient element 3153. The second positioning end 35522 of the second positioning element 3152 is exposed outside the second leading cavity 31540. The second resilient element 3153 ensures the second positioning end 31522 of the second positioning element 3152 being retained in one of the second positioning slots 315120 of the second adjusting body 3151. Preferably, the second resilient element 3153 is embodied as a compression spring having a second arranging space 31530, wherein the second mounting end 31521 of the second positioning element 3152 is mounted in the second arranging space 31530 of the second resilient element 3153, such that the second resilient element 3153 can be prevented from disengaging with the second locating second positioning element 3152.

Furthermore, each of the first rotating units 313 comprises a first rotation shell 3131 and a second rotation shell 3132, wherein the first rotation shell 3131 is integrally extended from the first lighting device 10*a*. The second rotation shell 3132 is mounted to the first rotation shell 3131 so that the first receiving cavity 311 and the first channel 312 are defined between the first rotation shell 3131 and the second rotation shell 3132. The first rotation shell 3131 and the second rotation shell 3132 are mounted with each other to form the respective first rotating unit 31 having the first projection 310. Preferably, the adjusting connection portion 31511 of the second adjusting member 315 is integrally extended from the second housing 3132.

Correspondingly, the second rotating unit 314 comprises a third rotation shell 3143 and a fourth rotation shell 3144, wherein the third rotation shell 3143 is integrally extended from the second lighting device 10*b*. The fourth rotation shell 3144 is mounted to the third rotation shell 3143 so that the second receiving cavity 3141 and the second channels 3142 are formed between the third rotation shell 3143 and the fourth rotation shell 3144. The third rotation shell 3143 and the fourth rotation shell 3144 are mounted with each other to form the second adjusting unit 314 having the second projection 3140. Preferably, the holding element 3154 is mounted to the third rotation shell 3143 so that the second leading cavity 31540 is formed between the holding element 3154 and the third rotation shell 3143.

Figure 2:
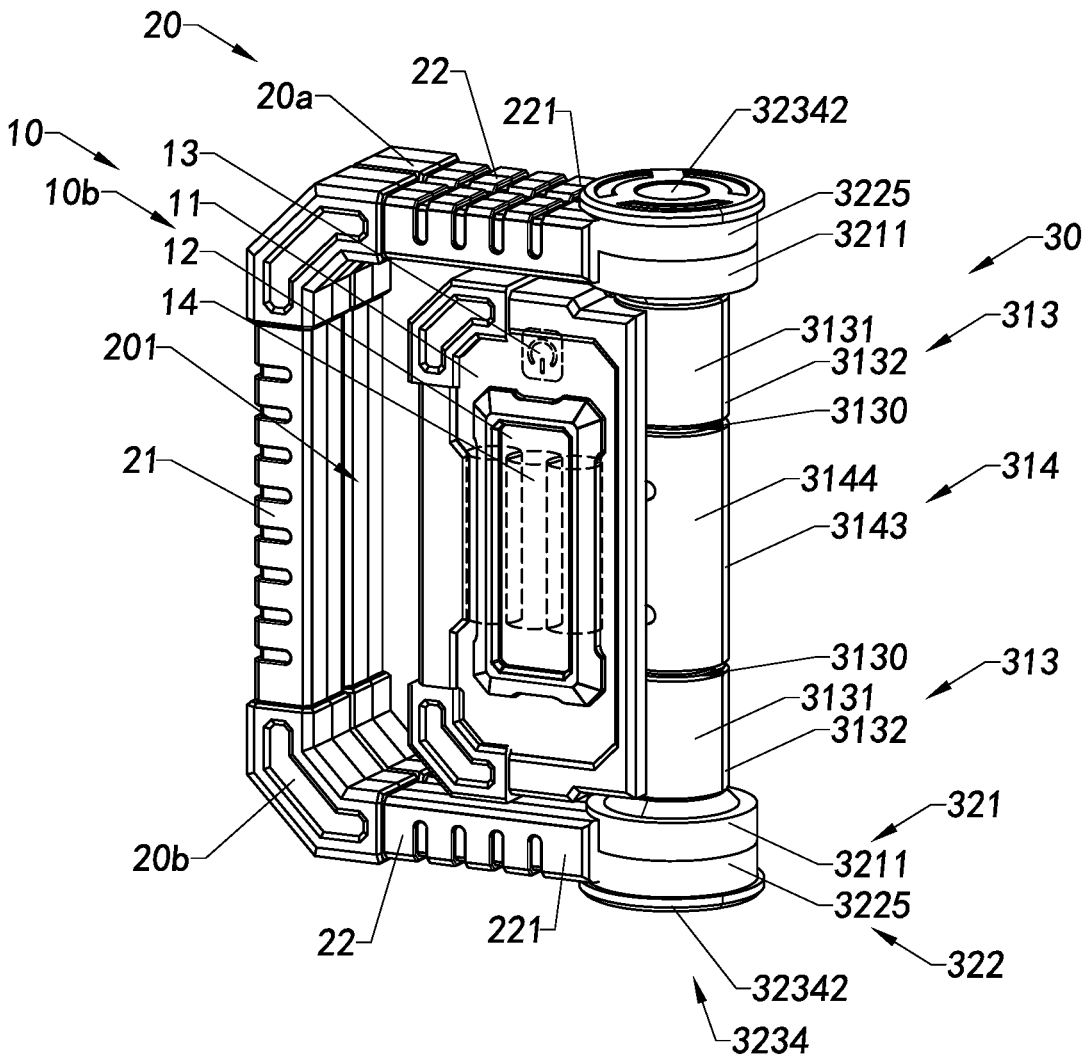
FIG. 2 is a perspective view of a portable lamp according to a preferred embodiment of the present invention.
Figure 3:
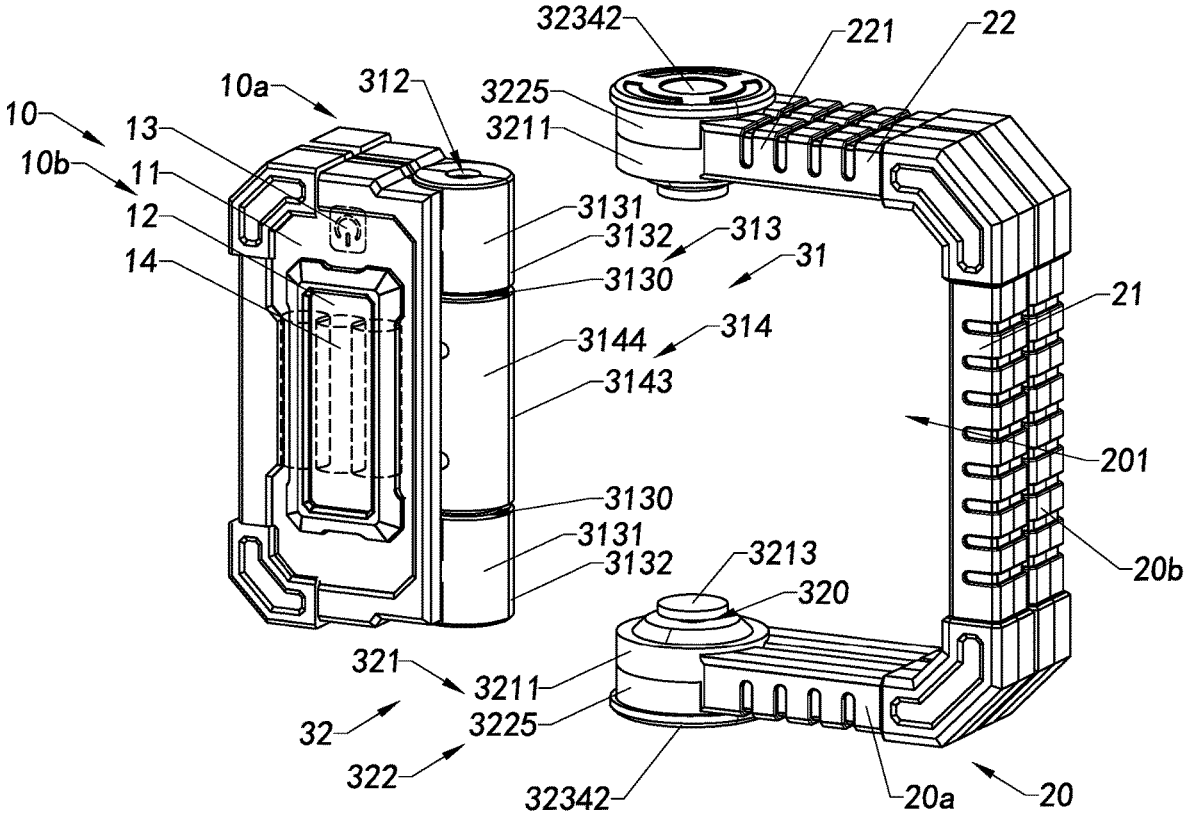
FIG. 3 is an exploded view of the portable lamp according to the above preferred embodiment of the present invention.
Figure 4:
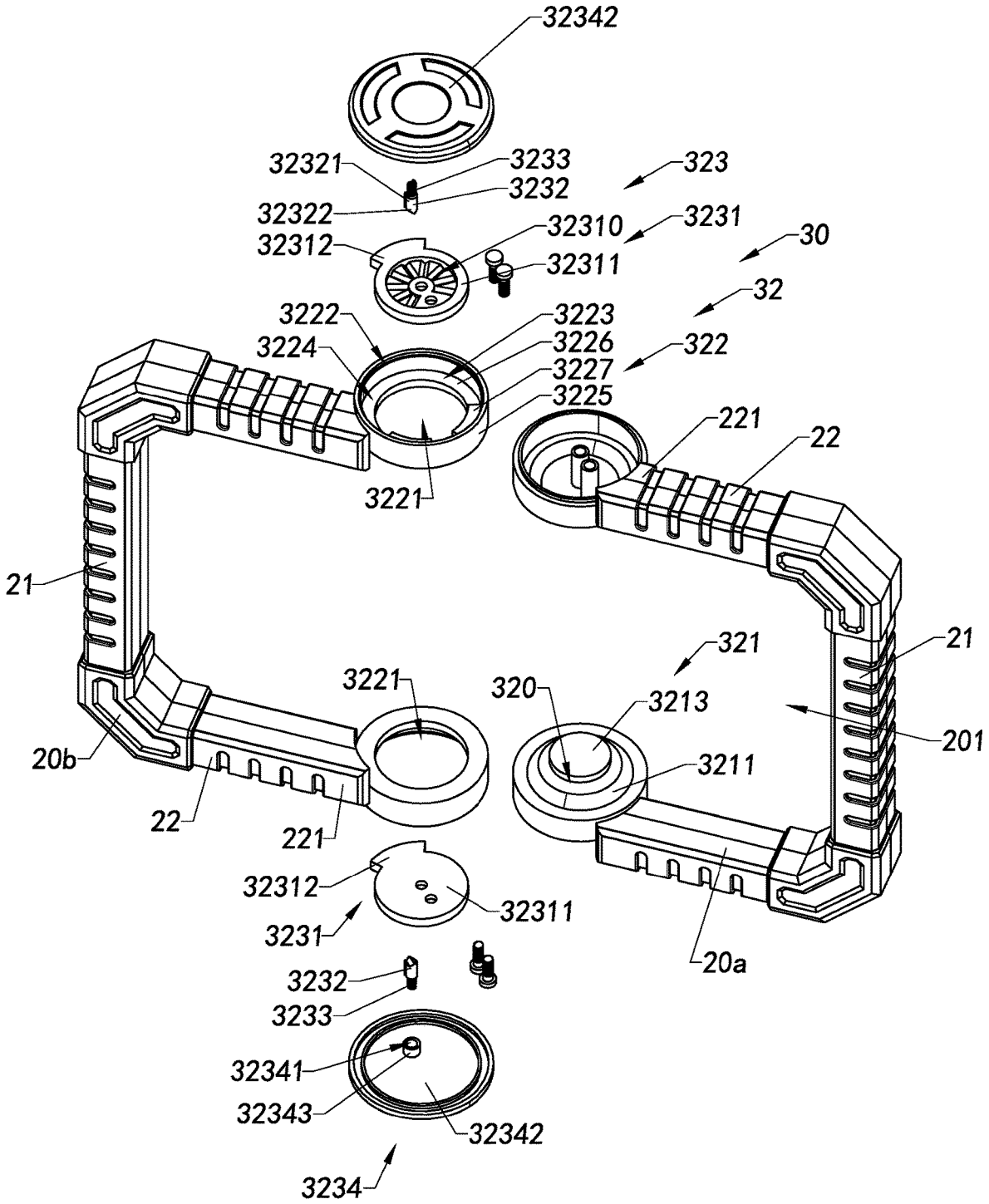
FIG. 4 is an exploded view illustrating the connecting position of the handle body and the adjusting unit of the portable lamp according to the above preferred embodiment of the present invention.

Referring to FIGS. 2 and 3, each of the first lighting device 10*a* and the second lighting device 10*b* comprises a housing 11 and a lighting portion 12 provided on the housing 11, wherein the lighting portion 12 can generate light when it is supplied with electric power. The two first rotating units 313 are respectively provided at two end portions of the housing 11 of the first lighting device 10*a* and the second rotating unit 314 is provided at a middle portion of the housing 11 of the second lighting device 10*b*. Preferably, the first rotatably housing 3131 of each of the first rotating units 313 is extended integrally from the housing 11 of the first lighting device 10*a* and the third rotation shell 3143 of the second rotating unit 314 is integrally extended from the housing 11 of the second lighting device 10*b*.

Furthermore, each of the first lighting device 10*a* and the second lighting device 10*b* comprises a switch 13 disposed on the housing 11 thereof, wherein the switch 13 is electrically and operatively connected with the lighting portion 12 of each of the first and second lighting devices 10*a*, 10*b* for controlling the operating state of the lighting portion 12. For example, the switch 13 is capable of controlling the on or off of the lighting portion 12 for generating light, controlling the lighting portion 12 to generate light in different manners, or controlling the lighting portion 12 to generate different types of light.

It is worth mentioning that the type of the lighting portion 12 should not be limited in the portable lamp of the present invention. Any kind of lighting portion 12 can be used as long as it can generate light after being supplied with electric power. For example, the lighting portion 12 can be implemented as LED lighting portion, or the lighting portion 12 may be embodied as including but not limited to one or more LED light emitting elements. Furthermore, the type of the switch 13 should also not be limited in the portable lamp of the present invention. For example, the switch 13 may be implemented as, but not limited to, a mechanical switch.

The operating states of the first lighting device 10*a* and the second lighting device 10*b* can be controlled independently. Accordingly, the users may choose to use only one of the first and second lighting devices 10*a*, 10*b* to produce light, to use both the first and second lighting device 10*a*, 10*b* to emit light, to control the first lighting device 10*a* and the second lighting device 10*b* to generate the same intensity or manner of light or different intensities or manners of light, or to control the first lighting device 10*a* and the second lighting device 10*b* to generate the same type or different types of light.

Furthermore, each of the first lighting device 10*a* and the second lighting device 10*b* comprises a power source 14 electrically connected with the lighting portion 12 thereof to supply electrical power to the lighting portion 12 thereof for generating light. Preferably, the lighting portion 12 is electrically connected to the supply portion 14 through the switch 13, so that the switch 13 controls the light emission of the lighting portion 12 by controlling the state of power supply of the power source 14 to the lighting portion 12. The type of the power source 14 in present invention should not be limited. For example, the power source 14 may be implemented as, but not limited to, rechargeable batteries, batteries and the like.

Referring to the FIG. 2 and FIG. 12A, the two handle bodies 20*a*, 20*b* of the portable lamp body 20 are in a folded state, wherein the handle elements 21 of the first handle body 20*a* and the handle second handle body 20*b* are folded to be overlapped with each other, wherein the first lighting device 10*a* is held and retained in the turning space 201 of the first handle body 20*a* and the second lighting device 10*b* is held and retained in the turning space 210 of the handle body 20*b*. At this time, the portable lamp has a relatively smaller size for ease of carrying and storing.

Preferably, if the parameter of the width size of the lighting device 10 is D1 and the parameter of the width size of the turning space 201 of the handle body 20 is D2, the value of the width size parameter D1 of the lighting device 10 is preferred less than the width size parameter D2 of the turning space 201. Accordingly, even after the lighting device 10 is held and retained in the turning space 201 of the handle body 20, there is a gap between a free side of the lighting device 10 and the handle elements 21 of the handle body 20, so that the portable lamp of the present invention allows the user to grip the handle elements 21 of the overlapping first and second handle bodies 20*a*, 20*b* to carry the portable lamp in the manner as shown in FIG. 12A.

FIG. 12B illustrates an operating state of the portable lamp that is the same state as shown in FIG. 12A. In other words, as shown in FIG. 12B, the handle elements 21 of the first and second handle bodies 20*a*, 20*b* are overlapped with together, wherein the first lighting device 10*a* is held in the turning space 201 of the handle body 20*a* and the second lighting device 10*b* is held in the turning space 201 of the second handle body 20*b*, and that the first lighting device 10*a* and the second lighting device 10*b* are in a back-to-back state. At this time, the first lighting device 10*a* and the second lighting device 10*b* can provide light towards opposite directions.

FIG. 12C illustrates another operating state of the portable lamp. When the portable lamp is in the operating state as shown in FIG. 12B, the user may firstly apply force to the lighting device 10 to rotate relatively with respect to the handle body 20, and then the user may apply forces to the first lighting device 10*a* and the second lighting device 10*b* to respectively rotate about the rotation shaft 31, so that the radiating directions of the light generated by the first lighting device 10*a* and the second lighting device 10*b* defines an included angle greater than 90° so as to provide light covering larger area in the operation environment.

When the first lighting device 10*a* and the second lighting device 10*b* are driven to rotate about the rotation shaft 31 respectively, each of the first rotating units 313 of the rotation shaft 31 and the first lighting device 10*a* are rotated simultaneously, the second rotating unit 314 of the rotation shaft 31 and the second lighting device 10*b* are rotated simultaneously. That is, each of the first rotating units 313 and the second rotating unit 314 are rotated simultaneously along with the first lighting device 10*a* and the second lighting device 10*b*. At this time, the second positioning end 31522 of the second positioning element 3152 can be positioned in different positions in the second positioning slot 315120 of the adjusting blocking portion 31512 of the second adjusting body 3151 under the applying force of the second resilient element 3153. After the external force applied for driving the first lighting device 10*a* and the second lighting device 10*b* to move with respect to each other is released, the second positioning end 31522 of the second positioning element 3152 is positioned at the second positioning slot 315120 of the second adjustment blocking portion 31512 of the second adjusting body 3151 for preventing the first lighting device 10*a* and the second lighting device 10*b* from rotating continuously with respect to each other, so as to retain the relative positions of the first lighting device 10*a* and the second lighting device 10*b* after being adjusted.

FIG. 12D illustrates another operating state of the portable lamp. When the portable lamp is in the operating state as shown in FIG. 12C, the user may continue to apply force to the first lighting device 10*a* and the second lighting device 10*b*, so that the first lighting device 10*a* and the second lighting device 10*b* are relatively rotated about the rotation shaft 31 until the first lighting device 10*a* and the second lighting device 10*b* are positioned in a shoulder-to-shoulder state, i.e. the included angle between the first and second lighting devices 10*a*, 10*b* is 180 degrees, wherein the light emitting directions of the first lighting device 10*a* and the second lighting device 10*b* are the same. That is, the first lighting device 10*a* and the second lighting device 10*b* may aim at the same direction to emit light, wherein since the first lighting device 10*a* and the second lighting device 10 are in the shoulder-to-shoulder state, this causes the light sources of the first and second lighting devices 10*a*, 10*b* of the portable lamp to be concentrated that substantially enhances the intensity of light generated from the first lighting device 10*a* and the second lighting device 10*b*.

FIG. 12E illustrates another operating state of the portable lamp. When the portable lamp is in the state as shown in FIG. 12D, the user may apply force to the first handle body 20*a* and the second handle body 20*b*, so that the first handle body 20*a* and the second handle body 20*b* are relatively moved around the rotation shaft 31 until the first handle body 20*a* and the second handle body 20*b* are rotated about the rotation shaft 31 from the folded state to the unfolded state. When the portable lamp is placed on a supporting surface, such as placing the portable lamp on a table or on the ground, one of the extending arms 22 of the second handle 20*a* and one of the extending arms 22 of the first handle body 20*b* form a triangular contact with the supporting surface that enables the portable lamp being stably supported and maintained in the operation environment.

When the first handle body 20*a* and the second handle body 20*b* are driven to be rotated relative to each other around the rotation shaft 31, the engaging member 321 and the first handle body 20*a* rotates simultaneously and the fastening member 322 and the second handle body 20*b* rotates simultaneously. At this time, the first positioning end 32322 of the first positioning element 3232 can be positioned at different positions in the first positioning slot 32310 of the first adjusting body 3231 under the resilient effect of the first resilient element 3233. After the external force that drives the first handle body 20*a* and the second handle body 20*b* is released, the first positioning end 32322 of the first positioning element 3232 is positioned at the first positioning slot 32310 of the first adjusting body 3231 to prevent the first handle body 20*a* and the second handle body 20*b* from continuing to rotate with respect to each other, so as to maintain the relative positions of the first handle body the 20*a* and the second handle body 20*b* in the adjusted state.

FIG. 12F illustrates another operating state of the portable lamp. When the first handle body 20*a* and the second handle body 20*b* of the portable lamp are in the unfolded state, the handle elements 21 of the first and second handle bodies 20*a*, 20*b* may also be placed on a supporting surface respectively for placing the portable lamp in the operation environment, wherein the first handle body 20*a* and the second handle body 20*b* are standing on the supporting surface in a reverse "V" shape that enables the portable lamp being stably supported and maintained in the operation environment.

According to another aspect of the present invention, the present invention further provides a manufacturing method of a portable lamp, wherein the manufacturing method comprises the following steps:

(a) rotatably coupling the two free ends 221 of the two extending arms 22 of a first handle body 20*a* to the two free ends 221 of the two extending arms 22 of a second handle body 20*b* respectively by one or more adjusting units 32; and (b) rotatably coupling two ends of a rotation shaft 31 which provides at least one lighting device 10 with the adjusting units 32 respectively to form the portable lamp.

Furthermore, the step (a) further comprises the steps of:

(a.1) providing an engaging member 321 at the free end 221 of each of the extending arms 22 of the first handle body 20*a*, for example, integrally forming the engaging member 321 at the free end 221 of each of the extending arms 22 of the first handle body 20*a;*

(a.2) providing a fastening member 322 at the free end 221 of each of the extending arms 22 of the second handle body 20*b*, for example, integrally forming the second fastening member 322 at the free end 221 of the extending arm 22 of the second handle body 20*b*; and (a.3) rotatably coupling the two engaging members 321 and the two fastening members 322 to form the two adjusting units 32 respectively, wherein in the step (b), both ends of the rotation shaft 31 are rotatably coupled with the engaging members 321 respectively.

It is worth mentioning that the step (a.1) and the step (a.2) do not require to process in a particular order.

Furthermore, the step (b) further comprises the following steps:

(b.1) providing two first rotating units 313 to the at least one lighting device 10;

(b.2) providing a second rotating unit 314 to another lighting device 10;

(b.3) rotatably coupling the second rotating unit 314 to each of the first rotating units 313, wherein the first rotating units 313 and the second rotating unit 314 form the rotation shaft 31; and (b.4) rotatably coupling the first turning elements 313 with the adjusting units 32 respectively.

It is worth mentioning that the step (b.1) and the step (b.2) do not require to process in a particular order.

Figure 13:
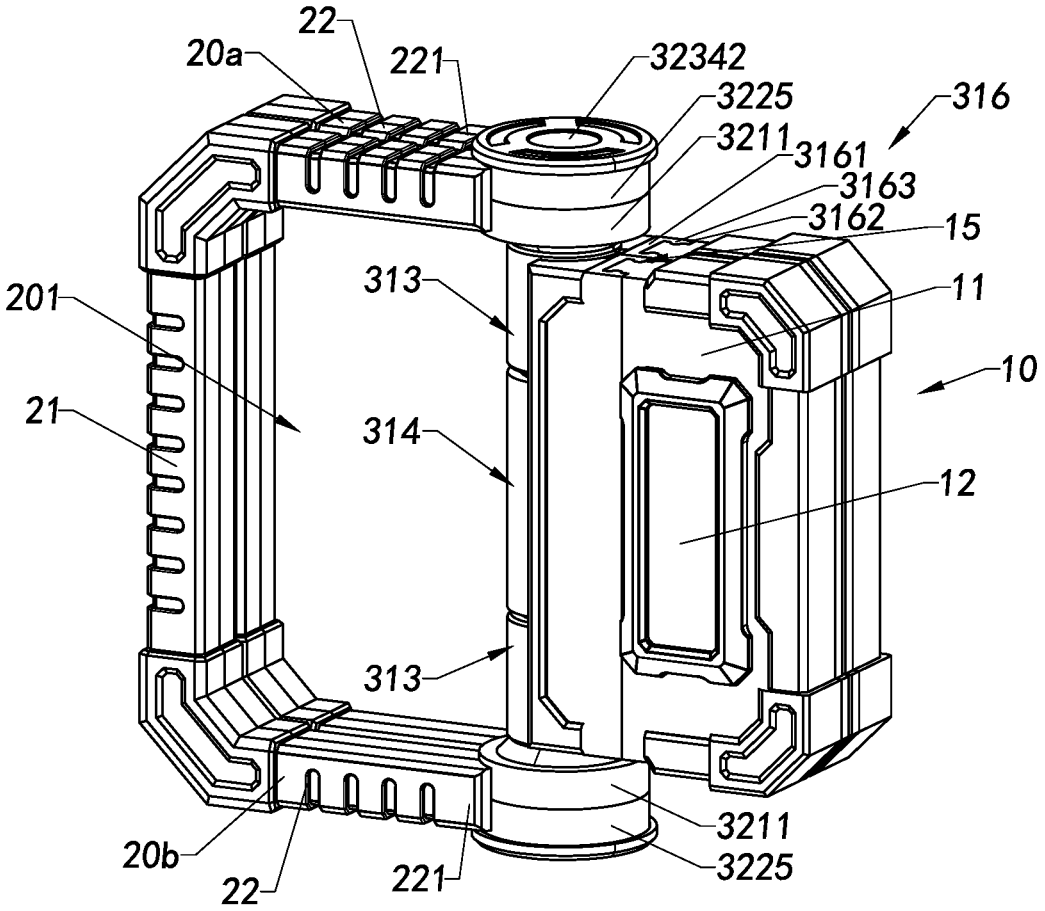
FIG. 13 is a perspective view of the portable lamp according to an alternative mode of the above preferred embodiment of the present invention.
Figure 14:
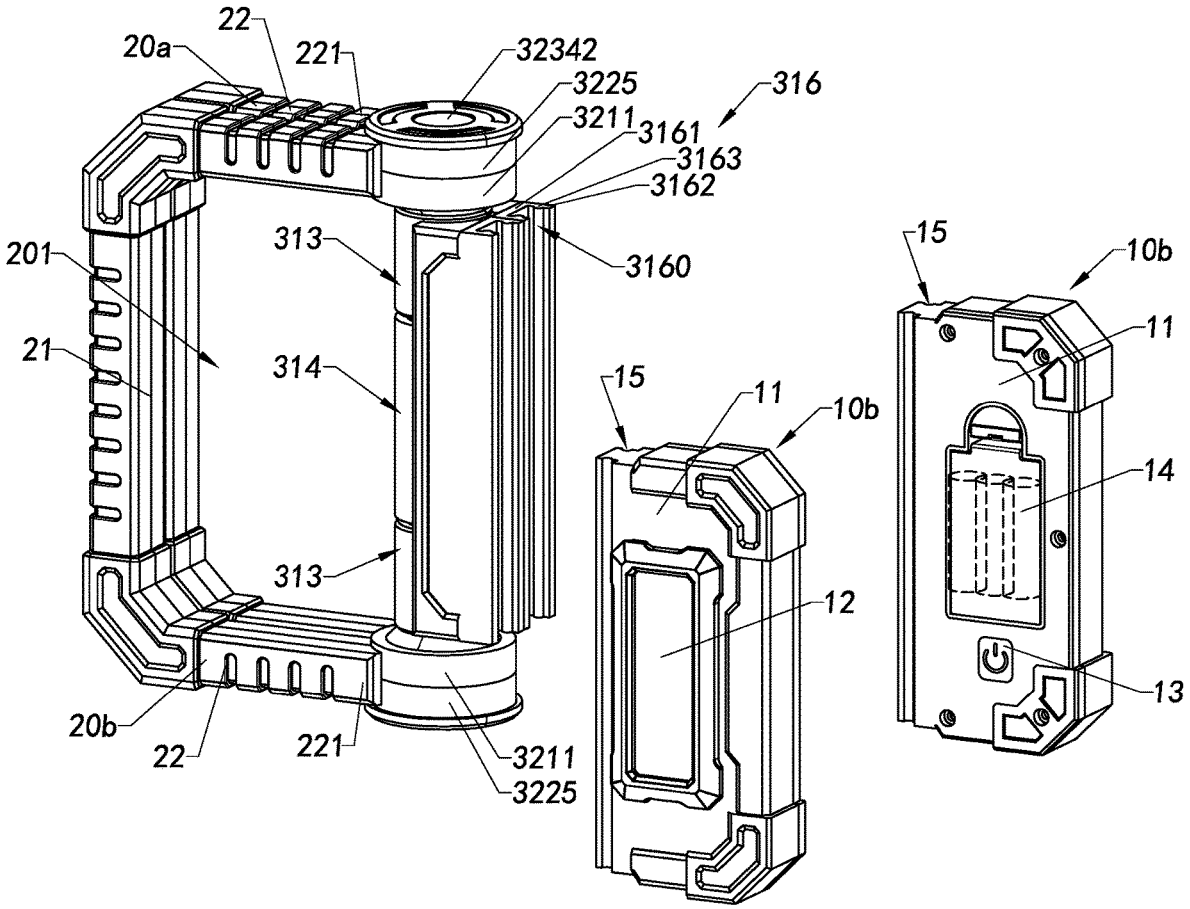
FIG. 14 is an exploded view of the portable lamp according to the above alternative mode embodiment of the above preferred embodiment of the present invention.

FIGS. 13 and 14 illustrate an alternative mode of the preferred embodiment of a portable lamp, which is different with the portable lamp as shown in FIG. 2 to FIG. 10 that, the at least one lighting device 10 of the portable lamp as shown in FIG. 13 and FIG. 14 is detachably connected with the rotation shaft 31 of the adjusting device 30, such that when any of the lighting devices 10 is unable to be used due to damage or other power reasons, only the lighting device 10 which is not suitable to be used continuously is required to be replaced, so that the maintenance cost and the usage cost of the portable lamp can be reduced. In addition, the lighting device 10 detached from the portable lamp can be used independently that allows the user to select the using mode of portable lamp, such as operating the at least one lighting device 10 with the handle bodies 20 or operating the lighting device independently without the handle bodies 20.

Specifically, the rotation shaft 31 comprises two first rotating units 313, a second rotating unit 314, two second adjusting members 315, and two mounting members 316, wherein the two first rotating units 313 are respectively coupled with two ends of the first lighting device 10*a* and the second rotating unit 314 is coupled at a middle portion of the second lighting device 10*b*, wherein the second rotating unit 314 is rotatably coupled between the two first rotating units 313, wherein the two second adjusting members 315 are respectively used to connect the two ends of each of the first rotating units 313 with the two ends of second rotating unit 314, and that the second adjustment members 315 can maintain the first rotating units 313 and the second rotating unit 314 in the adjusted state. The lighting devices 10 are detachably mounted to the mounting members 316 of the rotation shaft 31 respectively.

Each of the mounting members 316 has a mounting cavity 3160, wherein the lighting devices 10 are detachably mounted in the mounting cavities 3160 of the mounting members 316 respectively. Furthermore, each of the mounting members 316 further comprises a mounting body 3161 and two mounting arms 3162 parallelly extended from the mounting body 3161 to define the mounting cavity 3160 between the mounting body 3161 and the mounting arms 3162. The mounting body 3161 is provided on the first rotating units 313 or the second rotating unit 314. After the lighting device 10 is mounted in the mounting cavity 3160 of the mounting member 316, the lighting device 10 can be clamped in position by the mounting arms 3162 of the mounting member 316, so that the lighting device 10 is retained to be mounted on the rotation shaft 31.

Furthermore, the mounting member 316 further has at least one holding projection 3163 protruded on one of the mounting arms 3162 and positioned in the mounting cavity 3160. Correspondingly, the lighting device 10 has at least one limiting slot 15, wherein when the lighting device 10 is mounted in the mounting cavity 3160 of the mounting member 316, the limiting projection 3163 is retained in the holding slot 15 of the lighting device 10 to prevent the lighting device 10 detaching from the mounting member 316 so as to ensure the reliability of the portable lamp in use and being carried.

Figure 15:
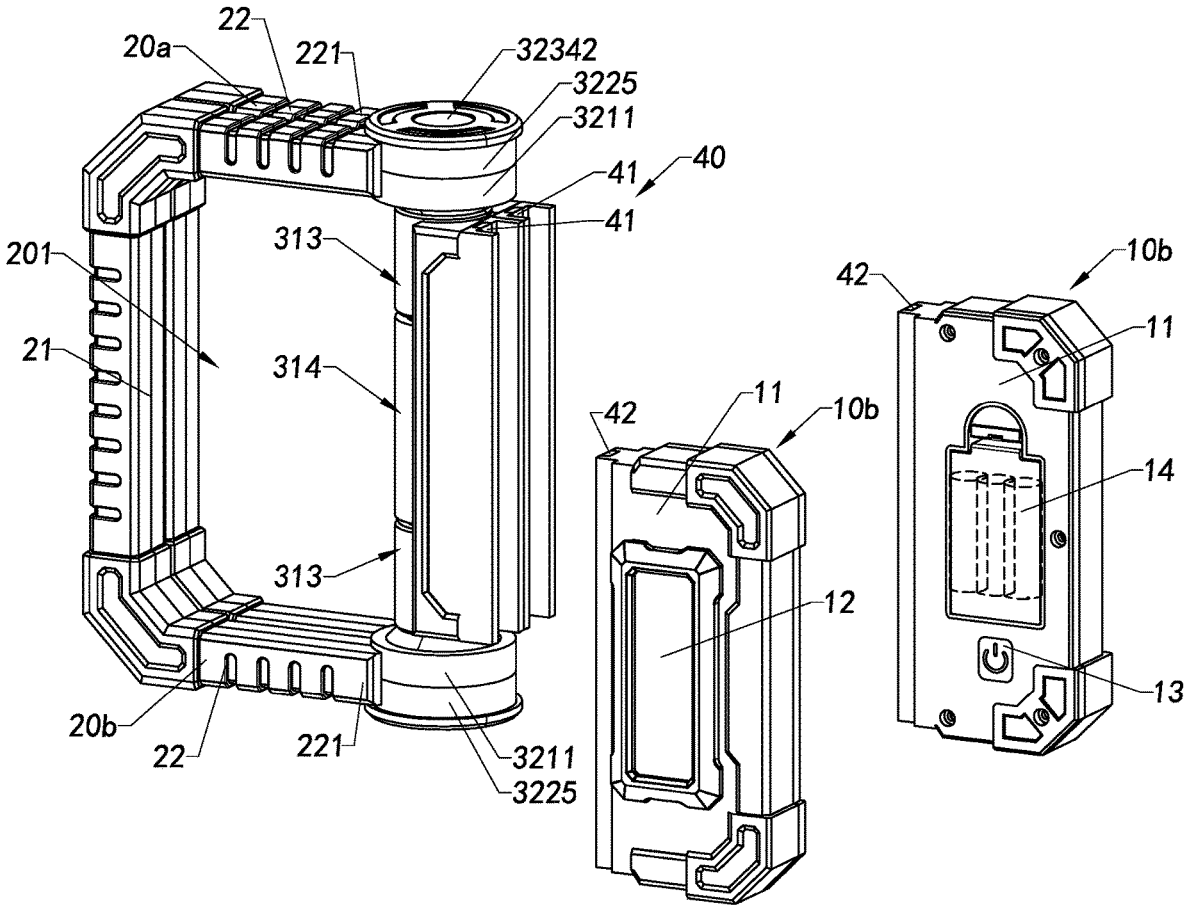
FIG. 15 is an exploded view of the portable lamp according to another alternative mode of the above preferred embodiment of the present invention.

FIG. 15 illustrates another alternative mode of the preferred embodiment of the portable lamp of the present invention. It is different from the portable lamp as shown in FIGS. 13 and 14 that the portable lamp as shown in FIG. 15 further comprises at least one connecting device 40, which comprises a first connecting element 41 and a second connecting element 42, wherein the first connecting element 41 is provided on the mounting member 316 and the second connecting element 42 is provided on the lighting device 10, wherein the first connecting element 41 is adapted to be connected with the second connecting element 42 so as to mount the lighting device 10 in the mounting cavity 3160 of the mounting member 316.

Preferably, the first connection element 41 and the second connection element 42 are connected with each other by means of magnetic attraction. Preferably, at least one of the first connection element 41 and the second connection element 42 is a magnetic element. That is, for example, both the first connection element 41 and the second connection element 42 are magnetic elements, or that only one of the first connection element 41 and the second connection element 42 is a magnetic element while the other one of the first and second connection element 41, 42 is a magnetic attractable metal element, such as, but not limited to, a ferrous element.

Referring to FIGS. 16 to 25B of the drawings of the present invention, a portable lamp according to another preferred embodiment of the present invention is illustrated, wherein the portable lamp comprises at least one lighting device 10, at least one handle body 20 and an adjusting device 30. The adjusting device 30 comprises a rotation shaft 31 and two adjusting units 32, wherein the at least one lighting device 10 is coupled with the rotation shaft 31 and each of the adjusting units 32 is coupled with the at least one handle body 20. Each of the adjusting units 32 is rotatably coupled with the rotation shaft 31, so that when the rotation shaft 31 is rotated relative to each of the adjusting units 32, the position and angle of the at least one lighting device 10 with respect to the at least one handle body 20 can be adjusted to change the radiation direction of the light generated by the at least one lighting device 10.

Preferably, when the rotation shaft 31 is driven to rotate relative to each of the adjusting units 32, the rotation shaft 31 drives the at least one lighting device 10 to rotate with respect to the at least one handle body 20 to adjust the position and angle of the at least one lighting device 10 with respect to the at least one handle body 20. More preferably, the position of the at least one lighting device 10 in relative to the at least one handle body 20 can be adjusted by rotation of the at least one lighting device 10 for large angle adjustment to ensure the radiation direction of the light generated by the at least one lighting device 10 meeting the requirement of the users. For example, the position of the at least one lighting device 10 relative to the at least one handle body 20 can be adjusted for 360° by rotating about the rotation shaft 31.

Furthermore, the at least one handle body 20 defines a turning space 201, wherein the at least one lighting device 10 can be rotated within the turning space 201 of the at least one handle body 20 and be held and retained in position in the turning space 201 of the at least one handle body 20. For example, when the at least one lighting device 10 is held and retained in the turning space 201 of the at least one handle body 20, the overall size of the portable lamp can be minimized for ease of conveniently operating, carrying and storing the portable lamp by the users.

It is worth mentioning that, according to this preferred embodiment of the portable lamp of the present invention, even when the at least one lighting device 10 is held and retained in the turning space 201 of the at least one handle body 20, the at least one lighting device 10 can still emit light for illumination in the operation environment.

Figure 16:
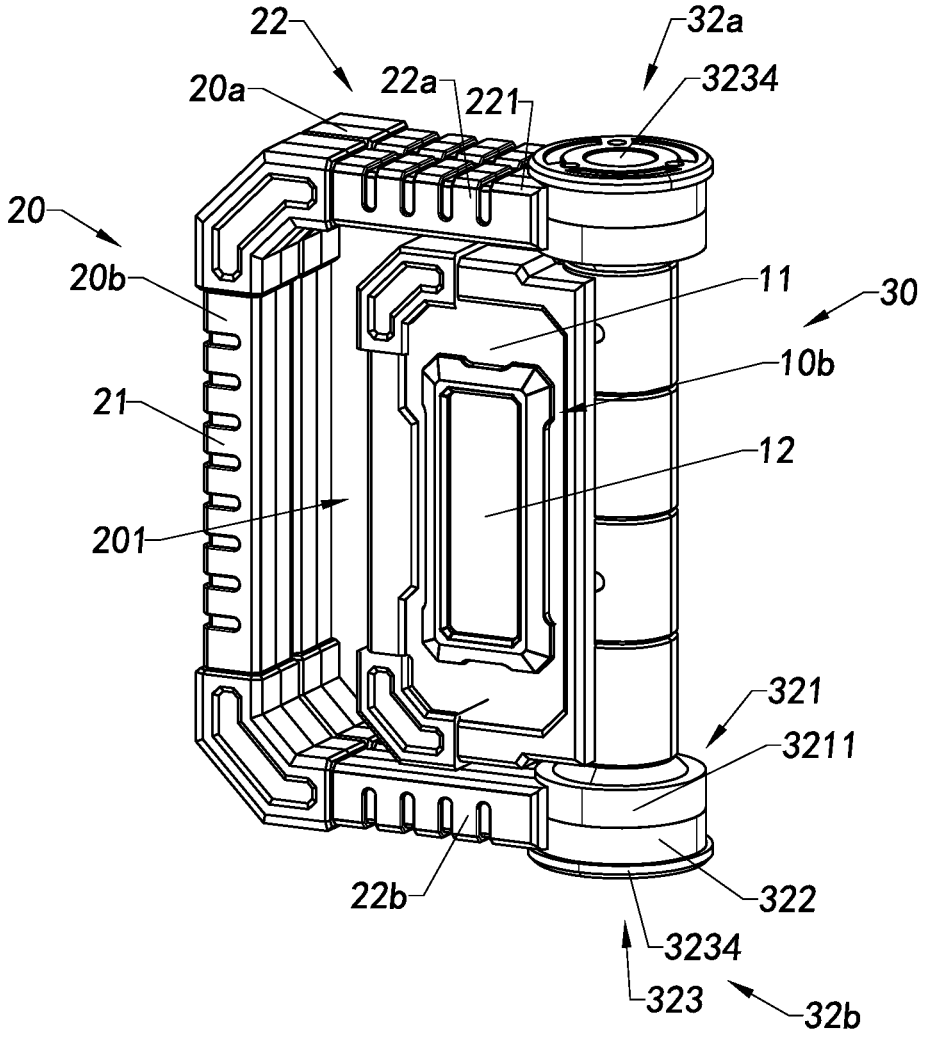
FIG. 16 is a perspective view of the portable lamp according to the above another preferred embodiment of the above preferred embodiment of the present invention.
Figure 17:
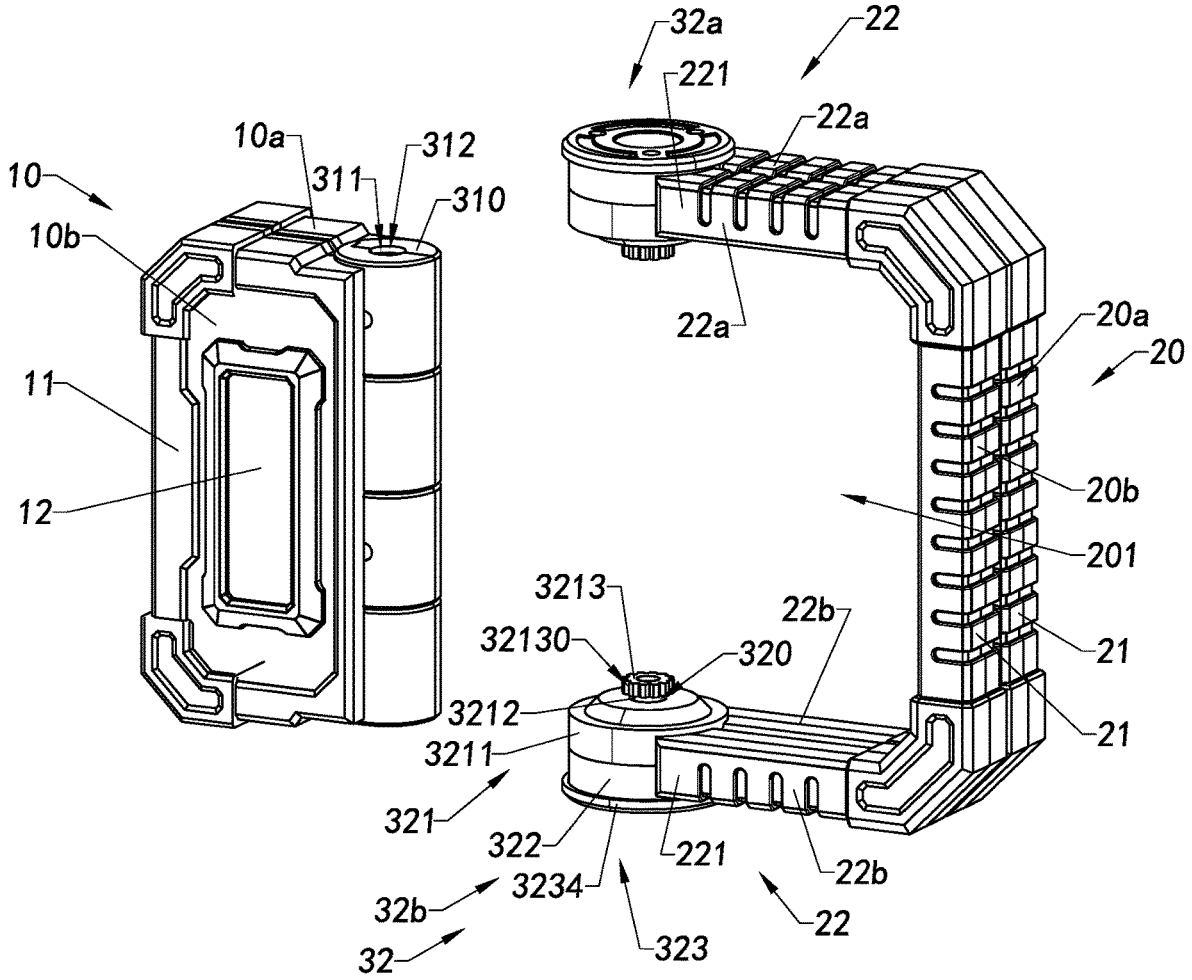
FIG. 17 is an exploded view of the portable lamp according to the above preferred embodiment of the present invention, illustrating the structural relationship between the lighting device and the handle body of the portable lamp.

Preferably, according to this preferred embodiment of the portable lamp as shown in FIGS. 16 and 17, the portable lamp is embodied to comprise two lighting devices 10 and two handle bodies 20.

It is worth mentioning that in order to facilitate the illustration of the features and advantages of the portable lamp of the present invention in the following description, one of the two lighting devices 10 is embodied and defined as a first lighting device 10*a*, and the other one of the two lighting devices 10 is embodied and defined as a second lighting device 10*b*, wherein the first lighting device 10*a* and the second lighting device 10*b* are respectively coupled with the rotation shaft 31 while the relative angles between the first lighting device 10*a* and the second lighting device 10*b* can be adjusted. For example, the first lighting device 10*a* and the second lighting device 10*b* can be adjusted to a back-to-back state so that the first lighting device 10*a* and the second lighting device 10*b* respectively provide light to two opposite directions. Or, the first lighting device 10*a* and the second lighting device 10*b* can be adjusted to a shoulder-to-shoulder state so that the first lighting device 10*a* and the second lighting device 10*b* respectively provide light towards the same direction. Alternatively, the first lighting device 10*a* and the second lighting device 10*b* can be adjusted to a tilted state so that an included angle is formed between the radiation direction of the light generated by the first lighting device 10*a* and the radiation direction of light generated by the second lighting device 10*b*.

Correspondingly, the portable lamp of this preferred embodiment is embodied to comprise two handle bodies, wherein one of the handle bodies 20 is defined as a first handle body 20*a* and the other handle body 20 is defined as a second handle body 20*b*, wherein the relative angle between the first handle body 20*a* and the second handle body 20*b* is adjustable to allow the user to select the operation state of the two handle bodies 20 as desired. Preferably, the two adjusting units 32 are adjustably connected to the first handle body 20*a* and the second handle body 20*b* respectively.

It is worth to mention that during the adjustment of the relative angle between the first lighting device 10*a* and the second light device 10*b*, the relative angle between the first handle body 20*a* and the second handle body 20*b* will not be affected. Correspondingly, during the adjustment of the relative angle between the first handle body 20*a* and the second handle body 20*b*, the relative angle between the first lighting device 10*a* and the second lighting device 10*b* will not be affected too. In other words, the relative angle between the first and second lighting devices 10*a*, 10*b* and the relative angle between the first and second handle bodies 20*a*. 20*b* can be adjusted independently, wherein the adjustment of the operation state of the first and second lighting devices 10 will not limit the operation state of the first and second handle bodies 20*a*, 20*b*, such that the flexible of the portable lamp in use can be ensured.

Referring to FIGS. 16 and 17, each of the handle bodies 20 comprises a handle element 21 and two extending arms 22. In other words, each of the first handle body 20*a* and the second handle body 20*b* comprises the handle element 21 and the two extending arms 22 which are extended from both ends of the handle element 21 to define the turning space 201 between the handle element 21 and the two extending arm 22. Preferably, the two extending arms 22 are bent and extended integrally and parallelly at both ends of the handle element 21 to form a "C" shaped or a "U" shaped frame, wherein the turning space 201 is formed between the handle element 21 and the two extending arms 22.

The first and second handle bodies 20*a*, 20*b* can be operated between an unfolded state and a folded state, and that the first and second handle bodies 20*a*, 20*b* can be switched between the unfolded state and the folded state. Preferably, the operation state of the first handle body 20*a* and second handle body 20*b* can be switched between the unfolded state and the folded state by means of the rotation of the first handle body 20*a* and/or the second handle body 20*b* about the rotation shaft 31.

According to the portable frame of the present invention, no matter the first handle body 20*a* and the second handle body 20*b* are unfolded or folded into an unfolded state or a folded state, both the first and second lighting devices 10*a*, 10*b* can provide illuminating light accordingly for illumination in the operation environment. In other words, it is merely a selective choice for the user to operate the portable lamp when the first handle body 20*a* and the second handle body 20*b* in the folded state or the unfolded state. Accordingly, the operating state of the first and second lighting devices 10*a*, 10*b* will not be limited or affected by the operating state, either the unfolded state or the folded state, of the first and second handle bodies 20*a*, 20*b*. For example, even when the first handle body 20*a* and the second handle body 20*b* are folded to overlap with each other to be operated in the folded state, the first lighting device 10*a* and the second lighting device 10*b* can also provide light to increase the flexibility of the portable lamp, or be rotated about the rotation shaft 31 to either fold up to overlap with each other in the folded state or unfolded to the shoulder-to-shoulder unfolded state.

It is worth mentioning that, when the first handle body 20*a* and the second handle body 20*b* are in the folded state, the handle element 21 of first handle body 20*a* and the handle element 21 of the second handle body 20*b* are overlapped with each other. Correspondingly, when the first handle body 20*a* and the second handle 20*b* are in the unfolded state, the handle element 21 of first handle body 20*a* and the handle element 21 of the second handle body 20*b* are unfolded to be separated from each other. One skilled in the art should understand that, when the first handle body 20*a* and the second handle 20*b* are in the unfolded state, the separation distance between the handle element 21 of first handle body 20*a* and the handle element 21 of the second handle body 20*b* are not limited.

Each of the extending arms 22 of each of the handle bodies 20 has a free end 221. Each of the adjusting units 32 of the adjusting device 30 is coupled at the free end 221 of the respective extending arm 22 and both ends of the rotation shaft 31 are respectively and rotatably coupled with the two adjusting units 32, so that each of the lighting devices 10 coupled with the rotation shaft 31 can be is rotated or retained within the respective turning space 201 of the respective handle body 20.

Referring to FIG. 17, each of the adjusting units 32 has a first slot 320 and each of the two ends of the rotation shaft 31 has a first projection 310, wherein the projections 310 of the rotation shaft 31 are rotatably engaged in the first slots 320 of the adjusting units 32 respectively, so that when the rotation shaft 31 is driven to rotate relative to each of the adjusting units 32, the first projections 310 of the rotation shaft 31 are respectively rotated in the first slots 320 of the adjusting units 32. And, the first projections 310 of the rotation shaft 31 are held and retained in the first slots 320 of the adjusting units 32 respectively so as to prevent the rotation shaft 31 from disengaging from each of the adjusting units 32.

In other words, when each of the first projection 310 of the rotation shaft 31 is rotating within the first slot 320 of the respective adjusting unit 32*b* while the first projections 310 of the rotation shaft 31 are held and retained in the first slots 320 of the adjusting units 32 respectively, the position and angle of each of the lighting devices 10 with respect to each of the handle body 20 will be adjusted accordingly.

In other alternative mode of the above preferred embodiment of the portable lamp of the present invention, each of the adjusting units 32 may comprise one of the first projections 310, and each end of the rotation shaft 31 may have one of the second slots 320, wherein the first projections 310 of the adjusting units 32 are rotatably engaged in the first slots 320 of the rotation shaft 31 respectively, so that the rotation shaft 31 can be rotated with respect to each of the first adjusting units 32.

Referring to FIG. 17, in order to facilitate the illustration of the features and advantages of the portable lamp according to the present invention in the following description, one of the adjusting units 32 is embodied and defined as the first adjusting unit 32*a*, and the other adjusting unit 32 is embodied and defined as the second adjusting unit 32*b*. One of the extending arms 22 of the first handle body 20*a* and one of the extending arms 22 of the second handle body 20*b* are defined as the first extending arm 22*a*. The other extending arm 22 of the first handle body 20*a* and the other extending arm 22 of the second handle body 20*b* are defined as the second extending arm 22*b*. In which, the first adjusting unit 32*a* is provided at the free end 221 of the first extending arm 22*a* of the first handle body 20*a* and the free end 221 of the first extending arm 22*a* of the second handle body 20*b*, such that the free end 221 of the first extending arm 22*a* of the handle body 20*a* and the free end 221 of the first extending arm 22*a* of the second handle body 20*b* are rotatably connected. Also, the second adjusting unit 32*b* is provided at the free end 221 of the second extending arm 22*b* of the first handle body 20*a* and the free end 221 of the second extending arm 22*b* of the second handle body 20*b*, such that the free end 221 of the second extending arm 22*b* of the handle body 20*a* and the free end 221 of the second extending arm 22*b* of the second handle body 20*b* are rotatably connected.

Referring to FIG. 17, each of the first adjusting unit 32*a* and the second adjusting unit 32*b* comprises an engaging member 321, a fastening member 322, and a first adjusting member 323. The engaging member 321 of the first adjusting unit 32*a* is provided at the free end 221 of the first extending arm 22*a* of the first handle body 20*a* and the fastening member 322 of the first adjusting units 32*a* is provided at the free end 221 of the second extending arm 22*b* of the first handle body 20*a*. The engaging member 321 of the second adjusting units 32*b* is provided at the free end 221 of the second extending arm 22*b* of the second handle body 20*b* and the fastening member 322 of the second adjusting units 32*a* is provided at the free end of the first extending arm 22*a* of the second handle body 20*b*. The first adjusting member 323 of the first adjusting unit 32*a* is used for coupling the engaging members 321 of the first adjusting unit 32*a* to the fastening member 322 of the second adjusting unit 32*b*, and the second adjusting member 323 of the second adjusting units 32*b* is used for coupling the fastening member 322 of the first adjusting units 32*a* and the engaging member 321 of the second adjusting units 32*b*. And, the first adjusting unit 323 of the first adjusting units 32*a* allows the engaging member 321 of the first adjusting unit 32*a* and the second adjusting member 323 of the second adjusting units 32*b* to be rotated with respect to each other. The first adjusting member 323 of the second adjusting units 32*b* allows the fastening member 322 of the first adjusting units 32*a* and the engaging member 321 of the second adjusting unit 32*b* to be rotated with respect to each other. Accordingly, the first handle body 20*a* and the second handle body 20*b* are capable of rotating with respect to each other about the rotation shaft 31, so that the first handle body 20*a* and the second handle body 20*b* are switchable between the unfolded state and the folded state.

The two engaging members 321 of the two adjusting units 32 are rotatably coupled with two end portions of the rotation shaft 31 respectively. Specifically, the engaging member 321 of each of the adjusting units 32 has the first slot 320. The two first projections 310 of the rotation shaft 31 are rotatably engaged in the two first slots 320 of the two engaging members 321 of the adjusting units 32 respectively, so as to coaxially couple the two end portions of the rotation shaft 31 with the engaging members 321 of the adjusting units 32 respectively in a rotatable manner.

Preferably, the engaging member 321 of the first adjusting units 32*a* is integrally extended from the free end 221 of the first extending arm 22*a* of the first handle body 20*a*. The fastening member 322 of the first adjusting units 32*a* is extended integrally from the free end 221 of the second extending arm 22*b* of the first handle body 20*a*. Correspondingly, the engaging member 321 of each of the second adjusting units 32*b* is integrally extended from the free end 221 of the second extending arm 22*b* of the second handle body 20*b* and the fastening member 322 of the second adjusting units 32*b* is integrally extended from the free end 221 of the first extending arm 22*a* of the second handle body 20*b*.

Furthermore, each of the engaging members 321 of the first adjusting units 32*a* and the second adjusting units 32*b* comprises an engaging body 3211, an engaging connection portion 3212, and an engaging blocking portion 3213. The engaging body 3211 of the engaging member 321 of the first adjusting unit 32*a* is provided at the free end 221 of the first extending arm 22*a* of the first handle body 20*a*. For example, the engaging body 3211 of the engaging member 321 of the first adjusting units 32 may be integrally formed at the free end 221 of the first extending arm 22*a* of the first handle body 20*a*. Correspondingly, the engaging body 3211 of the engaging member 321 of the second adjusting units 32*b* is provided at the free end 221 of the second extending arm 22*b* of the second handle body 20*b*. For example, the engaging body 3211 of the engaging member 321 of the second adjusting units 32*b* may be integrally formed at the free end 221 of the second extending arm 22*b* of the second handle body 20*b*. One end of the engaging connection portion 3212 is provided at an end of the engaging body 3211, and the engaging blocking portion 3213 is provided at the other end of the engaging body 3212, wherein the size of the engaging connection portion 3212 is smaller than the size of the engaging body 3211 and the size of the engaging blocking portion 3213, so that the first slot 320 is formed on the engaging connection portion 3212 corresponding to the engaging body 3211 and the engaging blocking portion 3213.

Preferably, the engaging body 3211 of the engaging member 321 of the first adjusting units 32*a* is integrally extended from the free end 221 of the first extending arm 22*a* of the first handle body 20*a*. The engaging body 3211 of the engaging member 321 of the second adjusting units 32*b* is integrally extended from the free end 221 of the second extending arm 22*b* of the second handle body 20*b*. One end of the engaging connection portion 3212 is integrally extended from a side of the engaging body 3211, and the engaging blocking portion 3213 is integrally extended from the other end of the engaging connection portion 3212.

Each of the end portions of the rotation shaft 31 has a first receiving cavity 311 and a first channel 312 communicating the receiving cavity 311 with outside, wherein the first projection 310 is provided corresponding to the first channel 312. In other words, the first projection 310 has a ring shape so as to form the first channel 312 between the first projections 310. In other words, the first channel 312 is formed approximately in the middle of the first projection 310.

The engaging blocking portions 3213 of the engaging members 321 are held and retained in the first receiving cavities 311 of the rotation shaft 31 respectively while the engaging bodies 3211 are respectively held outside of the rotation shaft 31. The engaging connection portions 3212 are held and retained in the first channels 312 of the rotation shaft 31 respectively while the first projections of the rotation shaft 31 are held and retained in the first slots 320 of the engaging members 321 respectively. Accordingly, the engaging members 321 are rotatably connected with the rotation shaft 31.

Preferably, a width of first slot 320 of each of the engaging members 321 is preferably arranged to match with the thickness of the respective first projection 310 of the rotation shaft 31. That is, a distance between the engaging body 3211 of each of the engaging members 321 and the engaging blocking portion 3213 is arranged to match with the thickness of the respective first projection 310 of the rotation shaft 31, such that it is possible to avoid any sloshing generated from the rotation shaft 31 in relative to the engaging members 321 to ensure the stability and reliability of the portable lamp in use.

More preferably, the engaging connection element 3212 of each of the engaging members 321 is a cylindrical body. That is, the cross-sectional shape of the engaging connection portion 3212 is circular and the first channel 312 of the rotation shaft 31 is a circular opening, so that when the rotation shaft 31 and the engaging members 321 are assembled together, the central axes of the rotation shaft 31 and the central axis of the engaging member 321 are coincided. Therefore, regardless of the angular rotation of the rotation shaft 31 and the engaging members 321 of the adjusting units 32, the central axis of the rotation shaft 31 and the central axes of the engaging members 321 can be coincided so as to guarantee the stability and reliability of the portable lamp in use.

Figure 18:
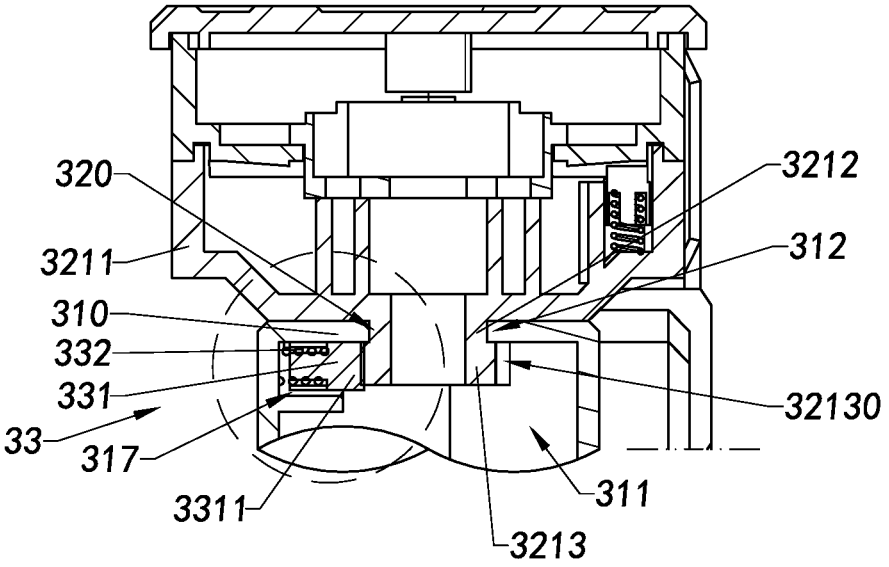
FIG. 18 is a partial sectional view illustrating the structural relationship of the lighting device and the handle body of the portable lamp according to the above preferred embodiment of the present invention.
Figure 19:
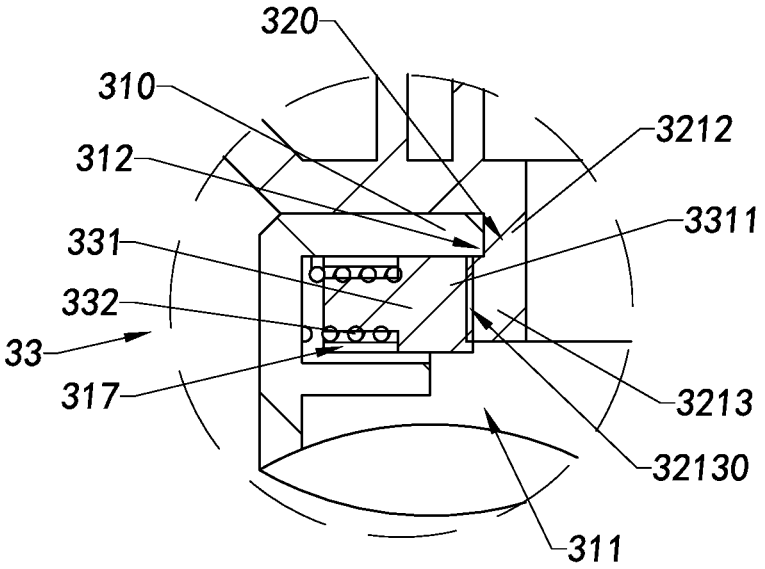
FIG. 19 is a partial enlarged view of FIG. 18.

Furthermore, referring to FIG. 18 and FIG. 19, the adjusting device 30 comprises two positioning units 33 coupled at two ends of the rotation shaft 31 respectively, wherein the positioning units 33 are positioned in the first receiving cavities 311 of the rotation shaft 31 respectively.

Furthermore, each of the positioning units 33 comprises a third positioning element 331 and a third resilient element 332, wherein each of the third positioning elements 331 has a third mounting end 3311 and a third positioning end 3312 corresponding to the third mounting end 3311. The third resilient element 332 is held and retained between the respective third positioning element 331 and the rotation shaft 31. When the third mounting end 3311 applies a force on the third resilient element 332, the third resilient element 332 is elastically deformed, so that the third resilient element 332 can provide a trend of resetting the third positioning element 331 to its initial position. Preferably, the third resilient element 332 is a compression spring.

Furthermore, each of the engaging blocking portions 3213 has a set of third positioning slots 32130, wherein the third positioning ends 3312 of the third positioning elements 331 are positioned in the third positioning slots 32130 of the engaging blocking portions 3213 respectively, so that the lighting devices 10 and the handle bodies 20 are able to be held and retained in their adjusted position after adjustment. When any of the lighting devices 10 and the handle bodies 20 is applied with a force to move the lighting device 10 and/or the handle body 20 in relative to each other, the third positioning element 331 of the third positioning end 3312 is able to be positioned in the respective third positioning slot 32130 at different position of the respective engaging blocking portion 3213, and after the external force applied to the lighting device 10 and/or the handle body 20 is released, the third positioning end 3312 of the third positioning element 331 can be reliably repositioned by the third resilient element 332 in one of the third positioning slots 32130 of the respective engaging blocking portion 3213, so as to hold and retain the lighting device 10 and/or handle body 20 in its adjusted position.

Referring to FIGS. 18 and 19, each of the end portions of the rotation shaft 31 has a third leading cavity 317 communicating with the first storage cavity 311, wherein the third resilient elements 332 are held in the third leading cavities 317 of the rotation shaft 31 respectively, wherein one end of the third resilient element 332 is mounted to the third mounting end 3311 of the respective third positioning element 331 and the third mounting end 3311 of the third positioning element 331 is movably disposed in the respective third leading cavity 317 of the rotation shaft 31. Each of the third leading cavities 317 of the rotation shaft 31 substantially guides the moving direction of the mounting end 3311 of the respective third positioning element 331 so as to prevent the third positioning element 331 deviates from its active position for ensuring the reliability of the portable lamp in use.

Figure 20:
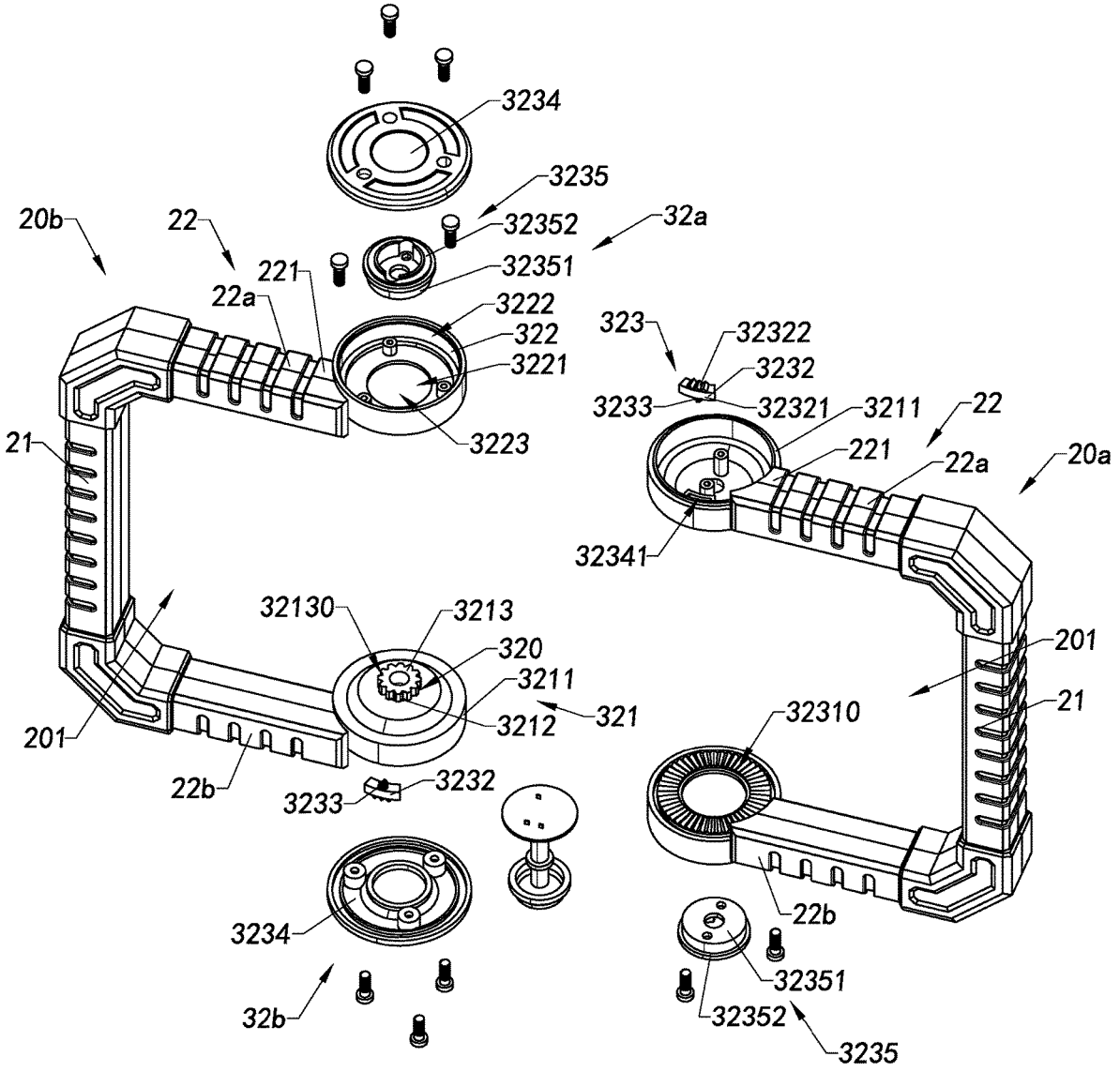
FIG. 20 is a partially exploded view of the portable lamp according to the above preferred embodiment of the present invention, illustrating the structural relationship of the two handle bodies of the portable lamp.
Figure 21:
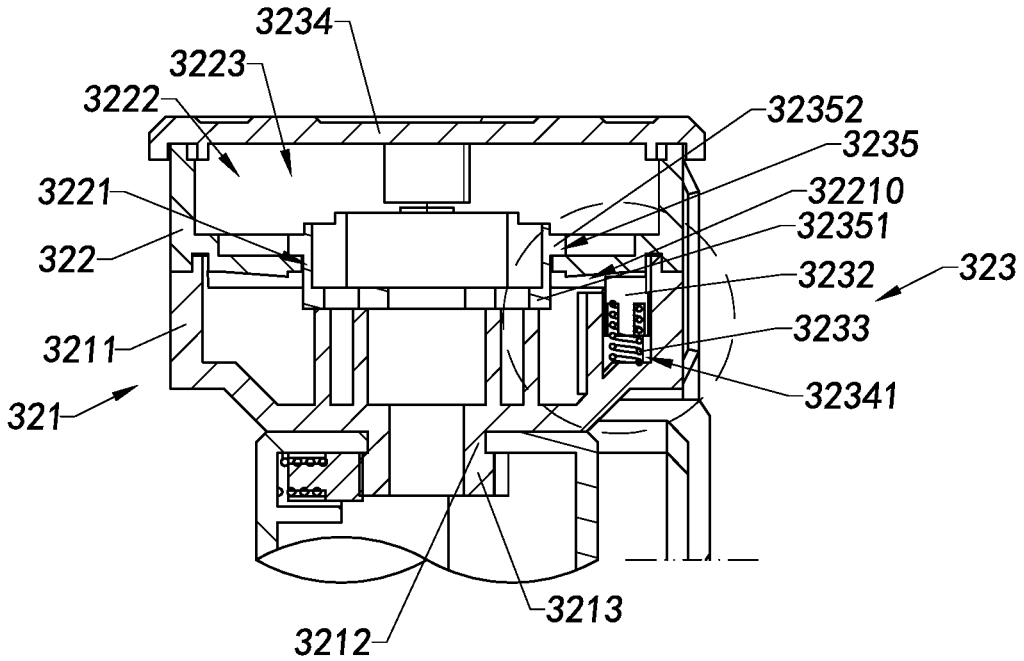
FIG. 21 is a partial sectional view of the portable lamp according to the above preferred embodiment of the present invention, illustrating the structural relationship between the two handle bodies of the portable lamp.
Figure 22:
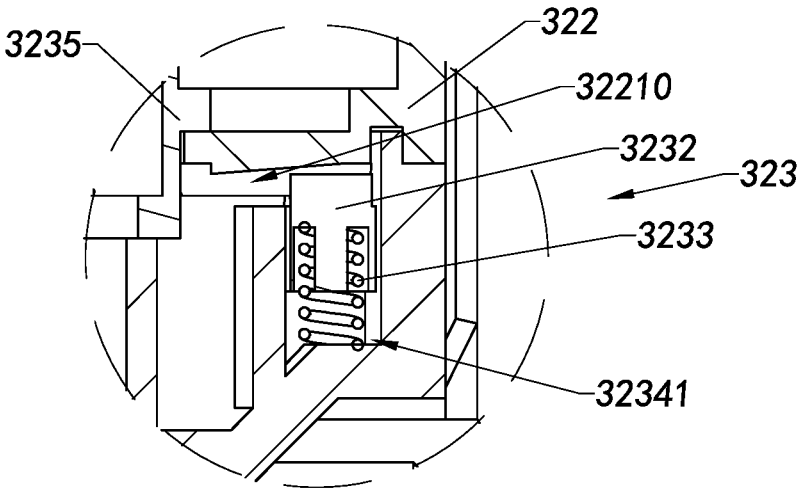
FIG. 22 is a partial enlarged view of FIG. 21.
Figure 23:
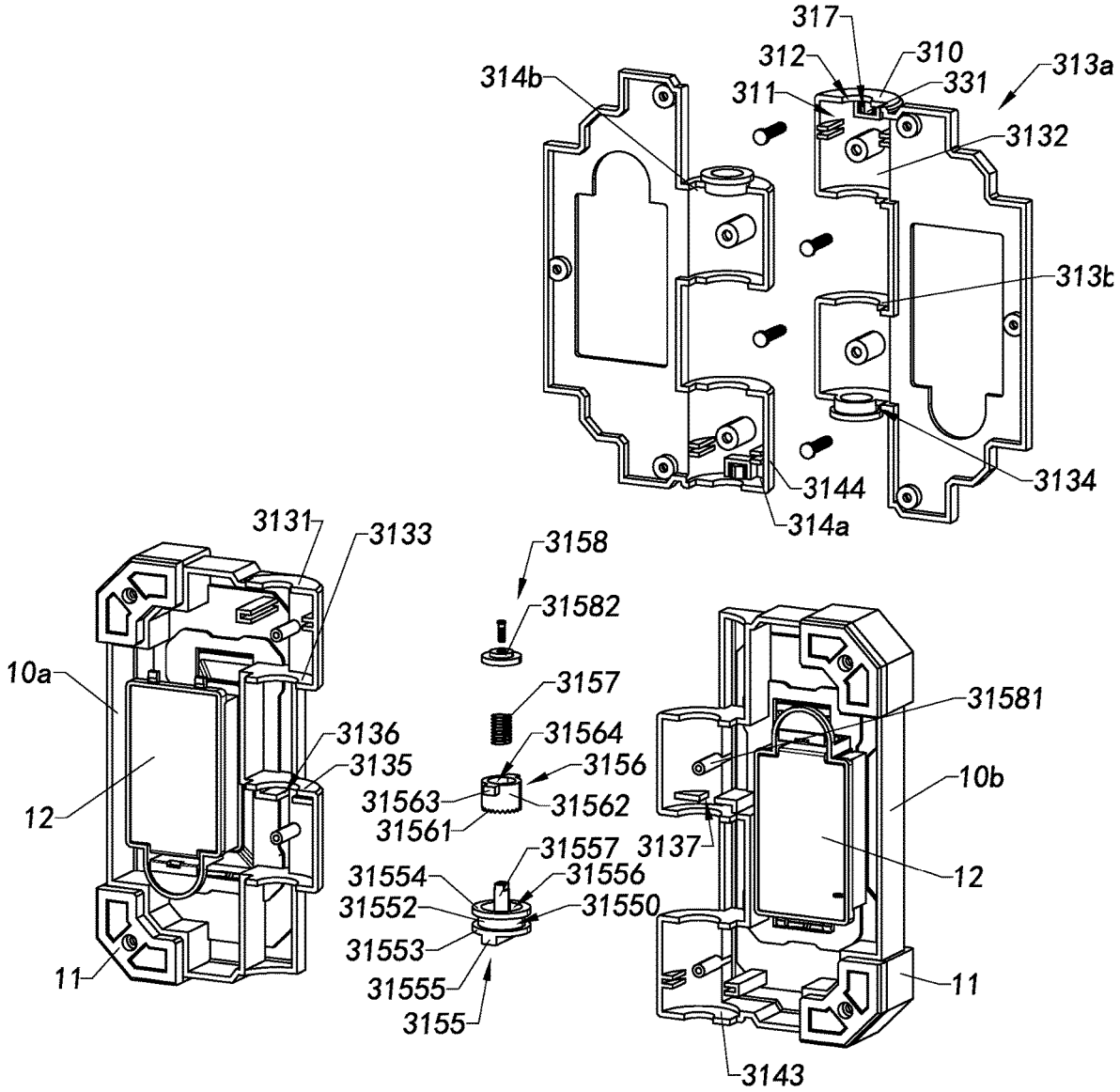
FIG. 23 is a partial exploded view of the portable lamp according to the above preferred embodiment of the invention, illustrating the structural relationship of the two lighting devices of the portable lamp.
Figure 24:
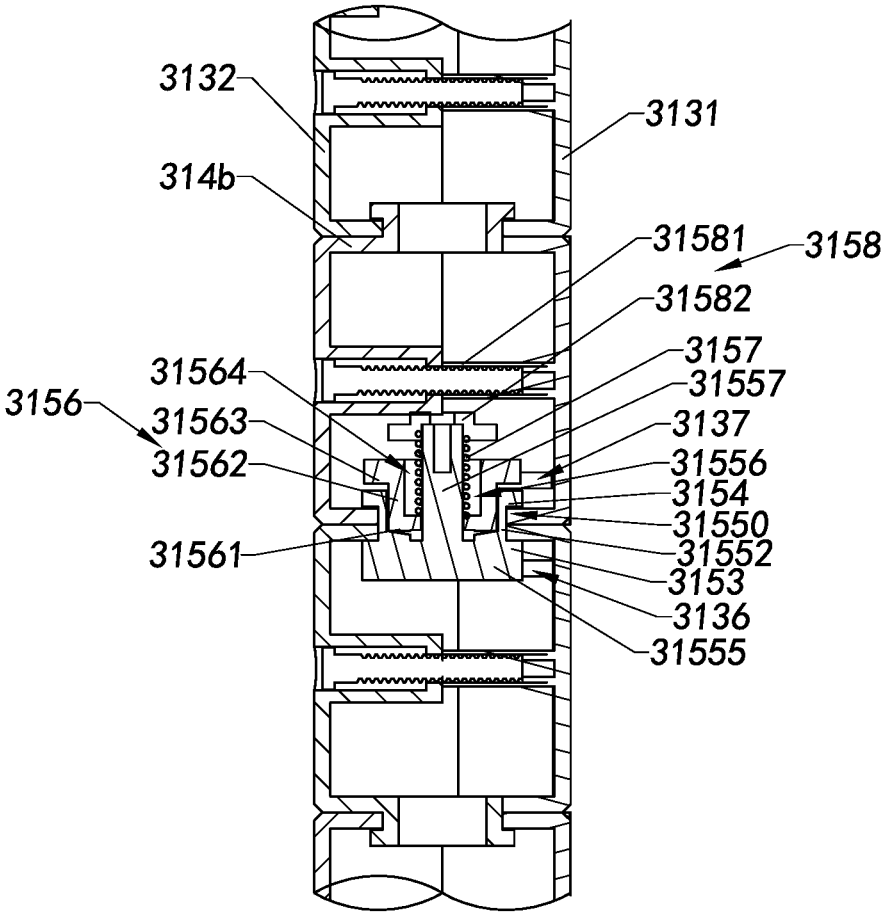
FIG. 24 is a partial sectional view of the portable lamp according to the above preferred embodiment of the invention, illustrating the structural relationship of the two lighting devices of the portable lamp.
Figure 25A:
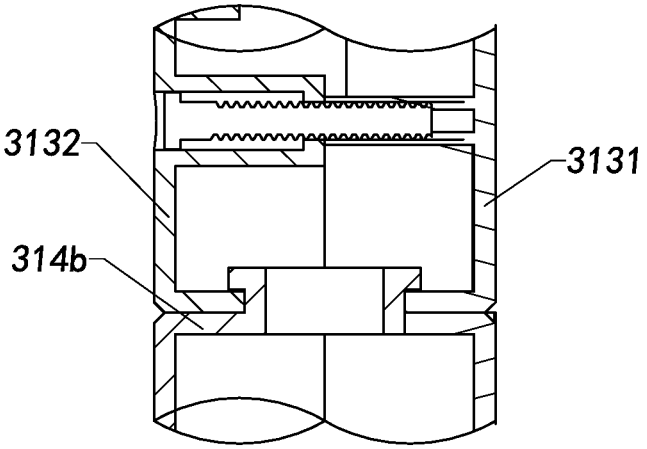
FIG. 25A is a partial enlarged view of FIG. 24.
Figure 25B:
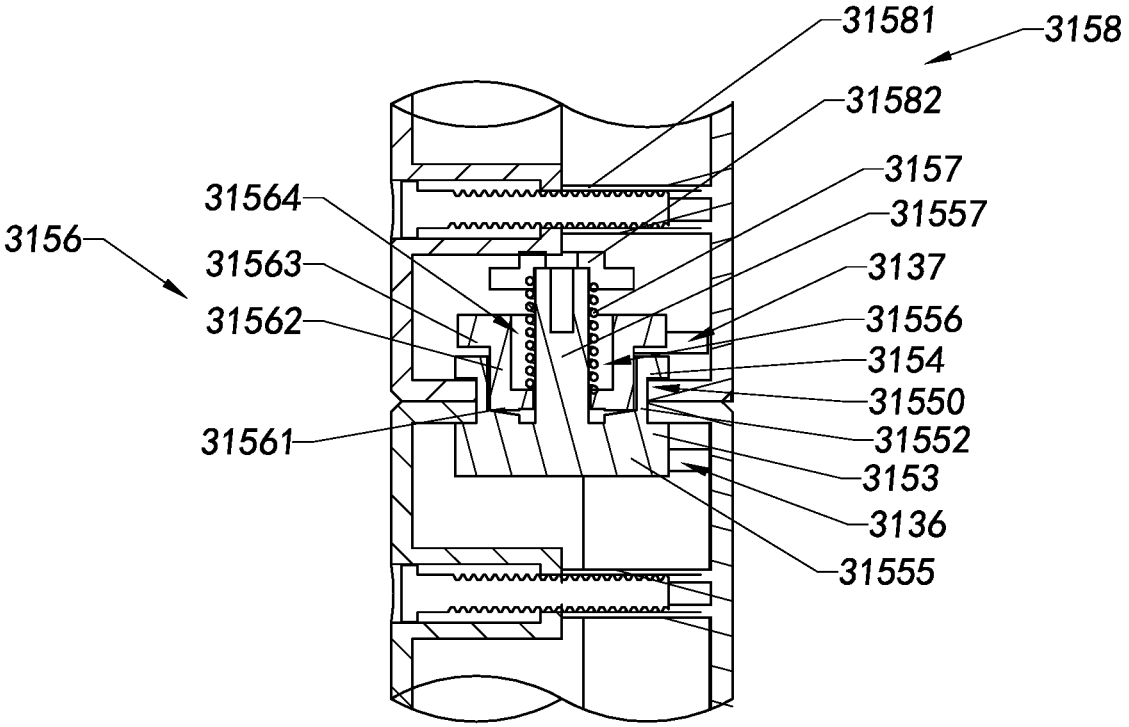
FIG. 25B is another partial enlarged view of FIG. 24.

Referring to FIG. 20 to FIG. 22, each of the fastening members 322 of the first adjusting unit **32*a* and the second adjusting unit 32*b* has a first opening 3221, a second opening 3222, and a fastening cavity 3223. The first opening 3221 and the second opening 3222 are respectively communicated with outside through two sides of the respective fastening member 322 so as to communicate the fastening cavity 3223 with the outside of the respective fastening member 322, and that the size of the first opening 3221 is preferably smaller than the size of the fastening cavity 3223. In addition, the fastening member 322 has a set of first positioning slots 32310 provided spacedly with each other, wherein each of the first positioning slots 32310 of the fastening member 322 faces the respective engaging member 321**.

Each of the first adjusting member 323 of the first adjusting units **32*a* and the first adjusting member 323 of the second adjustment unit 32*b* comprises a first positioning element 3232, a first resilient element 3233 and an assembling element 3235. Each of the first positioning elements 3232 has a first mounting end 32321 and a first positioning end 32322 corresponding to the first mounting end 32321, wherein the first resilient element 3233 is disposed between the first positioning element 3222 and the engaging member 321. The assembling element 3235 is used to install the fastening member 322 and the engaging member 321 together, so that the first positioning element 3232 and the first resilient element 3233 is held and retained between the fastening member 322 and the engaging member 321, and that the first positioning end 32322 of the first positioning element 3232 is positioned in one of the first positioning slots 32310 of the fastening members 322. When the first mounting end 32321 of the first positioning element 3232 applies a force on the first resilient element 3233, the first resilient element 3233 generates an elastic deformation that enables the first positioning element 3232 having a trend to reset to its initial position by means of the first resilient element 3233. Preferably, the first resilient element 3233** is a compression spring.

Specifically, the first positioning end 32322 of the first positioning element 3232 is positioned inside one of the first positioning slots 32310 of the fastening member 322 so as to hold and retain the first handle body **20*a* and the second handle body 20*b* in their adjusted positions after adjustment. When a force is applied to the first handle body 20*a* and the second handle body 20*b* for relative rotating movement, the first positioning end 32322 of the first positioning element 3232 can be positioned at different positions in the first positioning slots 32310 of the fastening member 322, and that after the external force applied to the first handle body 20*a* and the second handle body 20*b* is released, the first resilient element 3233 ensures the first positioning end 32322 of the first positioning element 3232 being reliably positioned in one of the first positioning slots 32310 of the fastening member 322, so that the first handle body 20*a* and the second handle body 20***b* are held and retained in their adjusted positions after adjustment, for example in the folded state or the unfolded state.

Furthermore, each of the engaging members 321 has a first guiding chamber 32341 which has an opening facing the fastening member 322. The first resilient element 3233 is held and retained in the first guiding chamber 32341 of each of the engaging members 321, wherein one end of the first resilient element 3233 is mounted to the first mounting end 32321 of the first positioning element 3232 while the first mounting end 32321 of the first positioning element 3232 is movably disposed in the first guiding chamber 32341 of the respective engaging member 321. The first guiding chamber 32341 of the engaging member 321 is adapted for guiding the movement direction of the first mounting end 32321 of the first positioning element 3232 to prevent the first positioning element 3232 deviating from its moving position so as to ensure the reliability of the portable lamp in use.

Moreover, each of the mounting members 3235 has a first assembling portion 32351 and a second assembling portion 32352 integrally formed at one end of the first assembling portion 32351, wherein the size of the first assembling portion 32351 is preferably smaller than the size of the second assembling portion 32352 while the size of the second assembling portion 32352 is preferably greater than the size of the first opening 3221 of the fastening member 322. The first assembling portion 32351 of the assembling element 3235 is mounted on the engaging member 321 after passing through the first opening 3221 from the fastening cavity 3223, and the second assembling portion 32351 of the assembling element 3235 is retained within the fastening cavity 3223 of the fastening member 322, so that the fastening member 322 and the engaging member 321 are rotatably mounted with each other.

Preferably, each of the first adjusting member 323 of the first adjusting units 32*a* and the second adjusting member 323 of the second adjustment unit 32*b* has a covering element 3234 provided at the fastening member 322 for covering and closing the second opening 3222 of the fastening member 322, so that the mounting member 3235 is hidden to ensure the aesthetic appearance of the portable lamp. It is worth mentioning that the manner of mounting the covering element 3245 on the fastening member 322 is not limited in the portable lamp of the present invention. For example, the covering element 3235 may be mounted on the fastening member 322 by screwing, or the covering element 3235 may be mounted on the fastening member 322 by gluing.

Furthermore, referring to FIG. 23 to FIG. 25B, the rotation shaft 31 comprises two first rotating units 313, two second rotating unit 314 and a second adjusting member 315, wherein the two first rotating units 313 are coupled with the first lighting device 10*a* and two of the second rotating unit 315 are coupled with the second lighting device 10*b*. One of the first rotating units 313 located in the middle position and one of the second rotating units 313 located in the middle position are rotatably connected by the second adjusting member 315, wherein the first rotating units 313 located on the side portion is rotatably coupled with the engaging member 321 of the first adjusting units 32*a* and the second rotating unit 314 located on the side portion is rotatably coupled with the second adjusting units 32*b* of the engaging member 321, so that the two first adjusting units 32 are rotatably coupled at the two end portions of the rotation shaft 31.

In particular, one of the first rotating units 313 is embodied and defined as a first side rotating unit 313*a* and the other one of the first rotating units 313 is embodied and defined as a first middle rotating unit 313*b*, wherein the first side rotating unit 313*a* is provided on the side portion of the first lighting device 10*a*, and the first middle rotating unit 313*b* is provided on the middle portion of first lighting device 10*a*. Correspondingly, one of the second rotating unit 314 is embodied and defined as a second side rotating unit 314*a* and the other one of the second rotating units 314 is embodied and defined as a second middle rotating unit 314*b*, wherein the second side rotating unit 314*a* is provided at the side portion of the second lighting device 10*b* and the second middle rotating unit 314*b* is provided at the middle portion of the second lighting device 10*b*. The second side rotating unit 314*a* and the second middle rotating unit 314*b* are rotatably coupled at two ends of the first middle rotating unit 313*b* respectively, and the first side rotating unit 313*a* and the first middle rotating unit 313*b* are rotatably coupled at the two ends of the second middle rotating unit of 314*b* respectively, wherein the first middle rotating unit 313*b* and the second middle rotating unit 314*b* are rotatably connected with each other by the second adjusting member 315, wherein the second adjusting member 315 maintains the first middle rotating unit 313*b* and the second middle rotating unit 314*b* in the adjusted state for enabling the first middle rotating unit 313*b* and the second middle rotating unit 314*b* to be held and retained in the adjusted state. In addition, the first side rotating unit 313*a* is rotatably connected with the engaging member 321 of the first adjusting unit 32*a*, and the second side rotating unit 314*a* is rotatably connected with the engaging member 321 of the second adjusting unit 32*b*.

The first side rotating unit 313*a* has the first projection 310, the first receiving cavity 311 and the first channel 312, wherein the engaging blocking portion 3213 of the engaging member 321 of the first adjusting unit 32*a* is held and retained in the first receiving cavity 311 of the first side rotating unit 313*a*. And, the engaging body 3211 is held outside of the first side rotating unit 313*a*. The engaging connection portion 3212 is held and retained in the first channel 312 of the first side rotating unit 313*a*. The first projection 310 of the first side turning element 313*a* is held and retained in the first slot 320 of the engaging member 321, such that the engaging member 321 of the first adjusting unit 32*a* and the first side rotating unit 313*a* are rotatably connected with each other.

Correspondingly, the second side rotating unit 314*a* has the first projection 310, the first receiving cavity 311 and the first channel 312, wherein the engaging blocking portion 3213 of the engaging member 321 of the first adjusting units 32*a* is held and retained in the first receiving cavity 311 of the second side rotating unit 314*a*. And, the engaging body 3211 is held outside of the second side rotating unit 314*a*. The engaging connection portion 3212 is held and retained in the first channel 312 of the second side rotating unit 314*a*. The first projection 310 of the second side rotating unit 314*a* is held and retained in the first slot 320 of the engaging member 321. In this manner, the engaging member 321 of the first adjusting units 32*a* and the first side rotating unit 313*a* are rotatably connected with each other.

Preferably, each of the first side rotating unit 313*a* and the second side rotating unit 314*a* further has a third projection 3133, wherein one of the third projections 3133 and one of the first projections 310 are respectively formed on the opposite ends of the first side rotating unit 313*a*, and the other one of the third projections 3133 and the other one of the first projections 310 are respectively formed at opposite ends of the second side rotating unit 314*a*. Correspondingly, each of the first middle rotating unit 313*b* and the second middle rotating unit 314*b* has a third slot 3134, wherein the third projection 3133 of the first side rotating unit 313*a* is movably engaged in the third slot 3134 of the second middle rotating unit 314*b*, and the third projection 3133 of the second side rotating unit 314*a* is movably engaged in the third slot 3134 of the first middle rotating unit 313*b*, so that both ends of the first middle rotating unit 313*b* are rotatably coupled with the second side rotating unit 314*a* and the second middle rotating unit 314*b* respectively, and both ends of the second middle rotating unit 314*b* are rotatably coupled with the first side rotating unit 313*a* and the first middle rotating unit 313*b* respectively.

Each of the first middle rotating unit 313*b* and the second middle rotating unit 314*b* has a fourth projection 3135 for fastening the second adjusting member 315.

In particular, the second adjusting member 315 comprises a first stopper 3155, which has a mounting slot 31550, wherein the fourth projection 3135 of the first middle rotating unit 313*b* and the second middle turning element 314*b* are respectively mounted in the mounting slot 31550 of the first stopper 3155, so that the first middle rotating unit 313*b* and the second middle rotating unit 314*b* are rotatably mounted together by means of the first stopper 3155 of the second adjusting member 315.

More specifically, the second adjusting member 315 further comprises a second stopper 3156, a fourth resilient element 3157 and a holder 3158. The holder 3158 comprises a first holding portion 31581 and a second holding portion 31582, wherein the first holding portion 31581 is integrally formed on the second middle rotating unit 314*b*, and the second holding portion 31582 is held against the first holding portion 31581 so as to limit the position of the second holding portion 31582 by the first holding portion 31581. The fourth resilient element 3157 is held and retained between the second holding portion 31582 and the second stopper 3156 and the second stopper 3156 is tightly fixed to the first stopper 3155 by the fourth resilient element 3157. The first stopper 3155 has a set of first locating teeth 31551 formed intervally and spacedly with each other and the second stopper 3156 has a set of second locating teeth 31561 formed intervally and spacedly with each other, wherein by tightly attaching the second stopper 3156 to the first stopper 3155 by means of the fourth resilient element 3157, the first locating teeth 31551 of the first stopper 3155 are engaged with the second locating teeth 31561 of the second stopper 3156, so that the first lighting device 10*a* and the second lighting device 10*b* are maintained in their adjusted positions after adjustment.

Specifically, the first locating teeth 31551 of the first stopper 3155 and the second locating teeth 31561 of the second stopper 3156 are engaged with each other such that the first lighting portion 10*a* and the second lighting device 10*b* are held and maintained in their adjusted positions. When a force is applied to the first lighting device 10*a* and/or the second lighting device 10*b* to rotate the first lighting device 10*a* and/or the second lighting device 10*b* in relative to each other, the first locating teeth 31551 of the first engaging member 3155 is able to engage with the second locating teeth 31561 of the second stopper 3156 at the different desired positions, and that after the external force applied on the first lighting device 10*a* and/or the second lighting portion 10*b* is released, the first locating teeth 31551 of the first stopper 3155 and the second locating teeth 31561 of the second stopper 3156 can engage with each other by means of the fourth resilient element 3157, such that the first lighting device 10*a* and the second lighting device 10*b* can be held and maintained in their adjusted positions after adjustment. For example, the first lighting device 10*a* and the second lighting device 10*b* can be selectively held and maintained in the back-to-back state or the shoulder-to-shoulder state.

Furthermore, each of the first middle rotating unit 313*b* and the second middle rotating unit 314*b* has a receiving slot 3136. The first stopper 3155 comprises a first stopper body 31552, a first stopper projection 31553 and a second stopper projection 31554. The first stopper projection 31553 and the second stopper projection 31554 are integrally and spacedly provided on the outside of the first stopper body 31552 to form the mounting slot 31550 between the first stopper projection 31553 of the second stopper projection and 31554, wherein as the first middle rotating unit 313*b* and the second middle rotating unit 314*b* are mounted in the mounting slot 31550 of the first stopper 3155, the first stopper projection 31553 is mounted in the receiving slot 3136 of the first middle rotating unit 313*b* and the second stopper projection 31554 is mounted in the receiving slot 3136 of the second middle rotating unit 314*b*, so that the first middle rotating unit 313*b* and the second middle rotating unit 314*b* are rotatably mounted together reliably by the first stopper 3155.

Furthermore, each of the first middle rotating unit 313*b* and the second middle rotating unit 314*b* has a holding space 3137. The first stopper 3155 comprises a first holding projection 31555 formed on the first stopper body 31552, wherein the first holding projection 31555 of the first stopper 3155 is mounted in the holding space 3137 of the first middle rotating unit 313*b* to prevent the first stopper 3155 from rotating with respect to the first middle rotating unit 313*b*.

The second stopper 3156 comprises a second stopper body 31562 and a second holding projection 31563, wherein the second holding projection 31563 is formed on the second stopper body 31562, wherein the second holding projection 31563 of the stopper element 3156 is mounted in the holding space 3137 of the second middle rotating unit 314*b* to prevent the second holding element 3156 from rotating with respect to the second middle rotating unit 314*b*.

Each of the first locating teeth 31551 is formed on the first holding body 31552 of the first holding element 3155 and each of the second locating teeth 31561 is formed on the second holding body 31562 of the second stopper 3156, wherein the fourth resilient element 3157 ensures the first stopper body 31552 and second stopper body 31562 being tightly fixed together, so as to ensure the first locating teeth 31551 and the second locating teeth 31561 being engaged with each other. In other words, the first holding body 31552 of the first holding element 3155 and the second locking body 31562 of the second holding element 3156 can be rotated relatively.

Preferably, the first stopper 3155 has a first stopper cavity 31556 formed in the first stopper body 31552, wherein the second stopper body 31562 of the second stopper 3156 is movably disposed in the first stopper cavity 31556 of the first stopper 3155.

More preferably, the first stopper 3155 comprises a leading pillar 31557 formed on the first stopper body 31552 and positioned in the first stopper cavity 31556. The second stopper 3156 has a second stopper cavity 31564 formed in the second stopper body 31562, wherein one end of the fourth resilient element 3157 is retained in the second stopper cavity 31564, wherein the leading pillar 31557 which passes through the second stopper body 31562 and a middle of the fourth resilient element 3157 is installed on the second holding portion 31582 so as to guide a deformation direction of the fourth resilient element 3157 by the leading pillar 31557.

Furthermore, each of the first side rotating unit 313*a* and the first middle rotating unit 313*b* comprises a first rotation shell 3131 and a second rotation shell 3132, wherein the first rotation shell 3131 is extended integrally from the first lighting device 10*a* and the second rotation shell 3132 is mounted to the first rotation shell 3131. Similarly, each of the second side rotating unit 314*a* and the second middle rotating unit 314*b* comprises a third rotation shell 3143 and a fourth rotation shell 3144, wherein the third rotation shell 3143 is integrally extended from the second lighting device 10*b* and the fourth rotation shell 3144 is mounted to the third rotation shell 3143.

Each of first lighting device 10*a* and the second lighting device 10*b* comprises a housing 11 and a lighting portion 12 disposed in the housing 11, wherein the lighting portion 12 comprises one or more light generating element such as LED for generating light when electricity is supplied. The two first rotating units 313 are spacedly provided at the housing 11 of the first lighting device 10*a* and the two second rotating units 314 are spacedly provided at the housing 11 of the second lighting device 10*b*. Preferably, the first rotation shell 3131 is integrally formed on the housing 11 of the first lighting device 10*a* and the third rotation shell 3133 is integrally formed on the housing 11 of the second lighting device 10*b*.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention comprises all modifications encompassed within the spirit and scope of the following claims.

What is claimed is:

1. A portable lamp, comprising:

a handle means comprising at least one handle body having two end portions and a turning space defined between said two end portions; and at least one lighting device which is rotatably mounted between said two end portions of said at least one handle body and selectively arranged to be maintained within said turning space of said at least one handle body as a folded state and to rotate with respect to said at least one handle body to define an included angle between said at least one lighting device and said at least one handle body as an unfolded state.

2. The portable lamp, as recited in claim 1, wherein said handle means comprises a pair of first handle body and second handle body, each of which comprises a handle element and two extending arms extended from two ends of said handle element respectively to define said turning space between said handle element and said extending arms, wherein the other two free ends of the two extending arms form said two end portions of each of said first and second handle bodies and both ends of said at least one lighting device are rotatably coupled with said two free ends of said two extending arms of each of said first and second handle bodies respectively.

3. The portable lamp, as recited in claim 2, further comprising an adjusting device, which comprises a rotation shaft and two adjusting units rotatably coupled at two ends of said rotation shaft respectively, wherein said at least one lighting device is mounted to said rotation shaft and said two adjusting units are rotatably coupled with said two free ends of said two extending arms of each of said first and second handle bodies respectively, so as to rotatably mount said at least one lighting device to said first and second handle bodies while said first and second handle bodies are able to be rotated with respect to each other and said at least one lighting device to adjust an included angle between said first and second handle bodies.

4. The portable lamp, as recited in claim 3, wherein the number of said at least one lighting device is two, wherein one of the lighting devices is defined as a first lighting device and the other lighting device is defined as a second lighting device, wherein said first lighting device and said second lighting device are rotatably coupled with each other by means of said adjusting device.

5. The portable lamp, as recited in claim 4, wherein said rotation shaft comprises at least one first rotating unit and at least one second rotating unit rotatably coupled with said at least one first rotating unit coaxially, wherein one end wherein said first lighting device is mounted to said at least one first rotating unit of said rotation shaft and said second lighting device is mounted to said at least one second rotating unit of said rotation shaft so that an included angle between said first and second lighting devices is adjustable by rotating said one of said first and second lighting devices with respect to the other one of said first and second lighting devices.

6. The portable lamp, as recited in claim 4, wherein said rotation shaft comprises at least one first rotating unit and at least one second rotating unit rotatably coupled with said at least one first rotating unit coaxially, wherein said first lighting device is detachably mounted to said at least one first rotating unit of said rotation shaft and said second lighting device is detachably mounted to said at least one second rotating unit of said rotation shaft so that an included angle between said first and second lighting devices is adjustable by rotating said one of said first and second lighting devices with respect to the other one of said first and second lighting devices, and that each of the first and second lighting devices is able to be detached from said rotation shaft and operated independently.

7. The portable lamp, as recited in claim 3, wherein each of said adjusting units has a first slot and each of said two ends of said rotation shaft has a first projection, wherein said two first projections of the rotation shaft are rotatably engaged with said two first slots of said two adjusting units respectively.

8. The portable lamp, as recited in claim 3, wherein each of said adjusting units has a first projection and each of said two ends of said rotation shaft has a first slot, wherein said two first projections of said two adjusting units are rotatably engaged with said two first slots of said rotation shaft respectively.

9. The portable lamp, as recited in claim 5, wherein each of said adjusting units has a first slot and each of said two ends of said rotation shaft has a first projection, wherein said two first projections of the rotation shaft are rotatably engaged with said two first slots of said two adjusting units respectively.

10. The portable lamp, as recited in claim 6, wherein each of said adjusting units has a first projection and each of said two ends of said rotation shaft has a first slot, wherein said two first projections of said two adjusting units are rotatably engaged with said two first slots of said rotation shaft respectively.

11. The portable lamp, as recited in claim 5, wherein each of said adjusting units has a first slot and each of said two ends of said rotation shaft has a first projection, wherein said two first projections of the rotation shaft are rotatably engaged with said two first slots of said two adjusting units respectively.

12. The portable lamp, as recited in claim 6, wherein each of said adjusting units has a first projection and each of said two ends of said rotation shaft has a first slot, wherein said two first projections of said two adjusting units are rotatably engaged with said two first slots of said rotation shaft respectively.

13. The portable lamp as recited in claim 7, wherein each of the adjusting units has a set of third positioning slot spacedly formed with each other, wherein said adjusting device further comprises two positioning units, wherein said positioning units are respectively coupled with said two ends of said rotation shaft, wherein each of said positioning units comprises a third positioning element and a third resilient element is held and retained between said third positioning element and said rotation shaft, wherein a positioning end of said third positioning element is able to be positioned at different positions of said third positioning slots of one of said adjusting units.

14. The portable lamp as recited in claim 8, wherein each of the adjusting units has a set of third positioning slot spacedly formed with each other, wherein said adjusting device further comprises two positioning units, wherein said positioning units are respectively coupled with said two ends of said rotation shaft, wherein each of said positioning units comprises a third positioning element and a third resilient element is held and retained between said third positioning element and said rotation shaft, wherein a positioning end of said third positioning element is able to be positioned at different positions of said third positioning slots of one of said adjusting units.

15. The portable lamp as recited in claim 9, wherein each of the adjusting units has a set of third positioning slot spacedly formed with each other, wherein said adjusting device further comprises two positioning units, wherein said positioning units are respectively coupled with said two ends of said rotation shaft, wherein each of said positioning units comprises a third positioning element and a third resilient element is held and retained between said third positioning element and said rotation shaft, wherein a positioning end of said third positioning element is able to be positioned at different positions of said third positioning slots of one of said adjusting units.

16. The portable lamp as recited in claim 10, wherein each of the adjusting units has a set of third positioning slot spacedly formed with each other, wherein said adjusting device further comprises two positioning units, wherein said positioning units are respectively coupled with said two ends of said rotation shaft, wherein each of said positioning units comprises a third positioning element and a third resilient element is held and retained between said third positioning element and said rotation shaft, wherein a positioning end of said third positioning element is able to be positioned at different positions of said third positioning slots of one of said adjusting units.

17. The portable lamp as recited in claim 11, wherein each of the adjusting units has a set of third positioning slot spacedly formed with each other, wherein said adjusting device further comprises two positioning units, wherein said positioning units are respectively coupled with said two ends of said rotation shaft, wherein each of said positioning units comprises a third positioning element and a third resilient element is held and retained between said third positioning element and said rotation shaft, wherein a positioning end of said third positioning element is able to be positioned at different positions of said third positioning slots of one of said adjusting units.

18. The portable lamp as recited in claim 12, wherein each of the adjusting units has a set of third positioning slot spacedly formed with each other, wherein said adjusting device further comprises two positioning units, wherein said positioning units are respectively coupled with said two ends of said rotation shaft, wherein each of said positioning units comprises a third positioning element and a third resilient element is held and retained between said third positioning element and said rotation shaft, wherein a positioning end of said third positioning element is able to be positioned at different positions of said third positioning slots of one of said adjusting units.

19. A manufacturing method of a portable lamp, comprising the steps of:

(a) rotatably coupling free ends of two extending arms of a first handle body with free ends of two extending arms of a second handle body respectively through two adjusting units respectively; and (b) rotatably coupling two ends of a rotation shaft mounted with at least one lighting device with said two adjusting units respectively, such that said first and second handle bodies are able to be rotated with respect to each other to adjust an included angle between said first and second handle bodies while said at least one lighting device is able to be rotated with respect to said first and second handle bodies to adjust an angle between said at least one lighting device and said first and second handle bodies.

20. The manufacturing method, as recited in claim 19, wherein each of said adjusting units has a first slot and each of said two ends of said rotation shaft has a first projection, wherein said two first projections of said rotation shaft are rotatably engaged with said two first slots of said adjusting units respectively.

21. The manufacturing method, as recited in claim 19, wherein each of said adjusting units has a first projection and each of said two ends of said rotation shaft has a first slot, wherein said two first slots of said rotation shaft are rotatably engaged with said two first projections of said adjusting units respectively.

22. The manufacturing method, as recited in claim 20, wherein two positioning units are provided at said two ends of the rotation shaft respectively, wherein each of said positioning units comprises a third positioning element and a third resilient element held and retained between said third positioning element and said rotation shaft, wherein when said first projections of said rotation shaft are rotatably engaged with said first slots of said adjusting units respectively, a positioning end of said third positioning element is retained by said third resilient element to position in one of a plurality of third positioning slots of one of said adjusting units.

23. The manufacturing method, as recited in claim 21, wherein two positioning units are provided at said two ends of the rotation shaft respectively, wherein each of said positioning units comprises a third positioning element and a third resilient element held and retained between said third positioning element and said rotation shaft, wherein when said first projections of said adjusting units are rotatably engaged with said first slots of said rotation shaft respectively, a positioning end of said third positioning element is retained by said third resilient element to position in one of a plurality of third positioning slots of one of said adjusting units.

24. The manufacturing method, as recited in claim 19, wherein the step (a) further comprises the steps of:

(a.1) providing an engaging member to said free ends of each of said extending arms of said first handle body;

(a.2) providing a fastening member to said free ends of each of said extending arms of said second handle body; and (a.3) rotatably mounting said engaging members and said fastening members respectively, wherein one of said engaging members and one of said fastening members form one of said adjusting units;

wherein in the step (b), said two ends of said rotation shaft are rotatably mounted to said two engaging members respectively.

25. The manufacturing method, as recited in claim 19, wherein said portable lamp comprises a first lighting device and a second lighting device and the step (b) further comprises the steps of:

(b.1) providing two first rotating units to said one of said first lighting device;

(b.2) providing a second rotating unit to said second lighting device;

(b.3) rotatably mounting said two rotating units with two ends of said second rotating unit to form said rotation shaft; and (b.4) rotatably mounting said two first rotating units with said two adjusting units respectively.

* * * * *